US008233630B2

(12) United States Patent
Asada

(10) Patent No.: US 8,233,630 B2
(45) Date of Patent: Jul. 31, 2012

(54) TEST APPARATUS, TEST METHOD, AND COMPUTER PROGRAM

(75) Inventor: Kohei Asada, Kanagawa (JP)

(73) Assignee: Sony Corporation (JP)

( * ) Notice: Subject to any disclaimer, the term of this patent is extended or adjusted under 35 U.S.C. 154(b) by 1706 days.

(21) Appl. No.: 11/067,883

(22) Filed: Feb. 28, 2005

(65) Prior Publication Data

US 2005/0207582 A1 Sep. 22, 2005

(30) Foreign Application Priority Data

Mar. 17, 2004 (JP) ..... P2004-076888
May 28, 2004 (JP) ..... P2004-159579

(51) Int. Cl.
*H04R 29/00* (2006.01)

(52) U.S. Cl. ..... 381/58; 381/56; 381/98

(58) Field of Classification Search ..... 381/56–59, 381/86, 98–106, 302–303; 84/623, 693, 84/603; 700/94; 702/77, 112, 124–126
See application file for complete search history.

(56) References Cited

U.S. PATENT DOCUMENTS 3,624,298 A * 11/1971 Davis et al. ..... 381/66
4,215,614 A 8/1980 Chibana et al.
4,458,362 A * 7/1984 Berkovitz et al. ..... 381/103
4,628,530 A * 12/1986 Op De Beek et al. ..... 381/103
4,773,094 A * 9/1988 Dolby ..... 381/58
5,361,305 A * 11/1994 Easley et al. ..... 381/58
5,748,001 A * 5/1998 Cabot ..... 324/624
6,608,904 B1 * 8/2003 Feltstom ..... 381/59
7,062,056 B2 * 6/2006 Jonkman ..... 381/312
7,123,731 B2 10/2006 Cohen et al.
7,747,027 B2 * 6/2010 Asada ..... 381/101
2001/0038702 A1 11/2001 Lavoie et al.

FOREIGN PATENT DOCUMENTS

DE 19580412 C1 10/1998
EP 352627 1/1990
EP 1180896 2/2002
GB 2239140 6/1991
JP 59040217 A 3/1984
JP 61-38998 2/1986
JP 2-276975 11/1990

(Continued)

OTHER PUBLICATIONS

Pohlmann; K.C. : "Principles of Digital Audio"1995, McGraw-Hill , New York 3 XP002473975 ISBN: 0-07-050469-5 p. 494; figures 15-5.

(Continued)

*Primary Examiner* — Vivian Chin
*Assistant Examiner* — Fatimat O Olaniran
(74) *Attorney, Agent, or Firm* — Lerner, David, Littenberg, Krumholz & Mentlik, LLP

(57) ABSTRACT

A sound element is generated by synthesizing, from a base sound, a frequency component of a sinusoidal wave one octave higher than the base sound. The base sound is a frequency component of one sinusoidal wave with an integer multiple of periods thereof matching a sample count represented by a power of 2. Sound elements having a frequency serving as a musical scale in a temperament are selected from the sound elements. The selected sound element is outputted in a predetermined pattern of time and a musical scale, so that a test tone is produced in a melody-like fashion.

10 Claims, 14 Drawing Sheets

FOREIGN PATENT DOCUMENTS

| | | | |
|---|---|---|---|
| JP | 5-241583 | | 9/1993 |
| JP | 6-43876 | | 2/1994 |
| JP | 7-133842 | | 5/1995 |
| JP | 8-115086 | | 5/1996 |
| JP | 9-16560 | | 1/1997 |
| JP | 10-032847 | | 2/1998 |
| JP | 2000-99009 | | 4/2000 |
| JP | 2001005455 | | 1/2001 |
| JP | 2001-346299 | A | 12/2001 |
| JP | 2002-6852 | | 1/2002 |
| JP | 2002330499 | A | 11/2002 |
| JP | 2002330500 | A | 11/2002 |
| JP | 2003-195859 | | 7/2003 |
| JP | 2003-204599 | A | 7/2003 |
| JP | 2003-526300 | A | 9/2003 |

OTHER PUBLICATIONS

European Serarch Report, EP 05 25 1518.

Office Action from Chinese Application No. 200510059429.9, dated Dec. 26, 2008.

Office Action from Japanese Application No. 2010-103400, dated Mar. 27, 2012.

* cited by examiner

FIG. 2

| | k=1 (BASE SOUND) (Hz) | CORRESPONDING APPROXIMATE ABSOLUTE TERMS (WITH RESPECT TO 445 Hz) | EQUAL TEMPERAMENT APPROXIMATE FREQUENCY (WITH RESPECT TO 455 Hz) (Hz) | k=2 (Hz) | k=3 (Hz) | k=4 (Hz) | k=5 (Hz) | k=6 (Hz) |
|---|---|---|---|---|---|---|---|---|
| m=9 | 210.94 | | | 421.88 | 843.75 | 1687.50 | 3375.00 | 6750.00 |
| m=10 | 234.38 | A# | 235.896 | 468.75 | 937.50 | 1875.00 | 3750.00 | 7500.00 |
| m=11 | 257.81 | | | 515.63 | 1031.25 | 2062.50 | 4125.00 | 8250.00 |
| m=12 | 281.25 | C# | 280.529 | 562.50 | 1125.00 | 2250.00 | 4500.00 | 9000.00 |
| m=13 | 304.69 | | | 609.38 | 1218.75 | 2437.50 | 4875.00 | 9750.00 |
| m=14 | 328.13 | | | 656.25 | 1312.50 | 2625.00 | 5250.00 | 10500.00 |
| m=15 | 351.56 | F | 353.445 | 703.13 | 1406.25 | 2812.50 | 5625.00 | 11250.00 |
| m=16 | 375.00 | F# | 374.462 | 750.00 | 1500.00 | 3000.00 | 6000.00 | 12000.00 |
| m=17 | 398.44 | G | 396.728 | 796.88 | 1593.75 | 3187.50 | 6375.00 | 12750.00 |
| m=18 | 421.88 | G# | 420.319 | 843.75 | 1687.50 | 3375.00 | 6750.00 | 13500.00 |
| m=19 | 445.31 | A | 445.313 | 890.63 | 1781.25 | 3562.50 | 7125.00 | 14250.00 |

※ $f = (48000/4096) \times m \times 2^k$

FIG. 4

| | k=0 (VIRTUAL BASE SOUND) (Hz) | k=1 (BASE SOUND) (Hz) | CORRESPONDING APPROXIMATE ABSOLUTE TERMS (WITH RESPECT TO 445 Hz) | EQUAL TEMPERAMENT APPROXIMATE FREQUENCY (WITH RESPECT TO 455 Hz) (Hz) | k=2 (Hz) | k=3 (Hz) | k=4 (Hz) | k=5 (Hz) | k=6 (Hz) |
|---|---|---|---|---|---|---|---|---|---|
| m=18 | 105.469 | 210.938 | | | 421.875 | 843.750 | 1687.500 | 3375.000 | 6750.000 |
| m=19 | 111.328 | 222.656 | A | 222.656 | 445.313 | 890.625 | 1781.250 | 3562.500 | 7125.000 |
| m=20 | 117.188 | 234.375 | A# | 235.896 | 468.750 | 937.500 | 1875.000 | 3750.000 | 7500.000 |
| m=21 | 123.047 | 246.094 | B | 249.923 | 492.188 | 984.375 | 1968.750 | 3937.500 | 7875.000 |
| m=22 | 128.906 | 257.813 | | | 515.625 | 1031.250 | 2062.500 | 4125.000 | 8250.000 |
| m=23 | 134.766 | 269.531 | | | 539.063 | 1078.125 | 2156.250 | 4312.500 | 8625.000 |
| m=24 | 140.625 | 281.250 | C# | 280.529 | 562.500 | 1125.000 | 2250.000 | 4500.000 | 9000.000 |
| m=25 | 146.484 | 292.969 | | | 585.938 | 1171.875 | 2343.750 | 4687.500 | 9375.000 |
| m=26 | 152.344 | 304.688 | | | 609.375 | 1218.750 | 2437.500 | 4875.000 | 9750.000 |
| m=27 | 158.203 | 316.406 | D# | 314.883 | 632.813 | 1265.625 | 2531.250 | 5062.500 | 10125.000 |
| m=28 | 164.063 | 328.125 | | | 656.250 | 1312.500 | 2625.000 | 5250.000 | 10500.000 |
| m=29 | 169.922 | 339.844 | | | 679.688 | 1359.375 | 2718.750 | 5437.500 | 10875.000 |
| m=30 | 175.781 | 351.563 | F | 353.445 | 703.125 | 1406.250 | 2812.500 | 5625.000 | 11250.000 |
| m=31 | 181.641 | 363.281 | | | 726.563 | 1453.125 | 2906.250 | 5812.500 | 11625.000 |
| m=32 | 187.500 | 375.000 | F# | 374.462 | 750.000 | 1500.000 | 3000.000 | 6000.000 | 12000.000 |
| m=33 | 193.359 | 386.719 | | | 773.438 | 1546.875 | 3093.750 | 6187.500 | 12375.000 |
| m=34 | 199.219 | 398.438 | G | 396.728 | 796.875 | 1593.750 | 3187.500 | 6375.000 | 12750.000 |
| m=35 | 205.078 | 410.156 | | | 820.313 | 1640.625 | 3281.250 | 6562.500 | 13125.000 |
| m=36 | 210.938 | 421.875 | G# | 420.319 | 843.750 | 1687.500 | 3375.000 | 6750.000 | 13500.000 |
| m=37 | 216.797 | 433.594 | | | 867.188 | 1734.375 | 3468.750 | 6937.500 | 13875.000 |
| m=38 | 222.656 | 445.313 | A | 445.313 | 890.625 | 1781.250 | 3562.500 | 7125.000 | 14250.000 |
| m=39 | 228.516 | 457.031 | | | 914.063 | 1828.125 | 3656.250 | 7312.500 | 14625.000 |
| m=40 | 234.375 | 468.750 | A# | 466.164 | 937.500 | 1875.000 | 3750.000 | 7500.000 | 15000.000 |
| m=41 | 240.234 | 480.469 | | | 960.938 | 1921.875 | 3843.750 | 7687.500 | 15375.000 |
| m=42 | 246.094 | 492.188 | B | 493.883 | 984.375 | 1968.750 | 3937.500 | 7875.000 | 15750.000 |
| m=43 | 251.953 | 503.906 | | | 1007.813 | 2015.625 | 4031.250 | 8062.500 | 16125.000 |

※ $f = (48000/4096) \times m \times 2^{(k-1)}$

※ Ta=4096 (SAMPLES) X 2/48000=0.17(S)

TEST APPARATUS, TEST METHOD, AND COMPUTER PROGRAM

BACKGROUND OF THE INVENTION

1. Field of the Invention

The present invention relates to a test apparatus, and a test method for performing an acoustic test for acoustic correction, and a compute program performed by the test apparatus.

2. Description of the Related Art

When listeners listen to audio signals replayed by a multichannel audio system through a plurality of speakers, an acoustic field of the sound changes in response to a change in the structure of a listening room, the balance and sound quality in response to an listening environment such as a structure of a listening room, and a listening position of each listener with respect to the speakers. Depending on the listening environment, the listener at the listening position is unable to listen to sounds from the speakers in an appropriate acoustic field.

Such a problem is pronounced in a compartment of an automobile. Since the listening position of the listener is generally limited to a seat position in the automobile compartment, a distance permitted between each of speakers and the listener is typically limited to within a certain range. In such an environment, the balance of the acoustic field is significantly destroyed due to a time difference in arrival time of sounds from speakers. The compartment of the automobile is a relatively small closed space, and reflected sounds are scrambled in a complex manner and then reach the listener, thereby disturbing a desired acoustic field. The limitation imposed on the mounting position of the speakers rarely allows a sound to directly reach the ears of the listener. This factor causes a change in sound quality, thereby significantly affecting the acoustic field.

An acoustic correction technique is known to produce an acoustic field of an original sound source as faithful as possible under a listening environment of an audio system. Predetermined signal processing is performed in the audio signal to be outputted from the speaker. For example, a delay time is adjusted to correct a time difference between sounds reaching the ears of the listener. Also, an equalization correction is performed to correct, in sound quality and listening level of the sounds, a change in the sounds reaching the ears of the listener.

To efficiently perform the acoustic correction, the audio system preferably performs an automatic adjustment instead of a listener's manual adjustment depending on the listener's acoustic sense.

An acoustic correction apparatus measures acoustic characteristics of a listening environment, and sets a signal process parameter for acoustic correction on an audio output line of the audio system. If the audio signal processed in accordance with the set parameter is outputted from the speakers, a sound is enjoyed in an excellent audio field adaptively corrected to the listening environment without the need for the listener's acoustic manual adjustment.

The acoustic characteristics are measured as below as disclosed in Japanese Unexamined Patent Application Publication No. 2001-346299, for example. Microphones are placed at a listening position corresponding to the position of the ears of the listener. The acoustic correction apparatus causes a speaker to output a test sound, the outputted test sound is picked up by the microphone, and the picked up test sound is sampled. The acoustic correction apparatus determines a signal processing parameter for acoustic correction based on the results of a frequency analysis process performed on the sampled sound.

A pink noise is typically used to measure the test sound. During test, the listener hears the noise sound. The noise sound is far from comfortable to the listener.

SUMMARY OF THE INVENTION

According to one aspect of the present invention, a test apparatus includes an output unit for outputting, as a test sound source, a sound element according to a minimum output unit equal to a predetermined sample count expressed by a power of 2, wherein the sound element is obtained based on a particular frequency component of a sinusoidal wave, a integer multiple of periods of the sinusoidal wave matching the predetermined sample count, a sampling unit for sampling an audio signal obtained as a result of capturing a sound in space, at a predetermined timing according to the minimum sample unit equal to the sample count, and a test unit for obtaining test results in terms of a predetermined test item from analysis results that are obtained by executing a predetermined frequency analysis on the audio signal sampled by the sampling unit.

According to another aspect of the present invention, a test method comprising steps of outputting, as a test sound source, a sound element according to a minimum output unit equal to a predetermined sample count expressed by a power of 2, wherein the sound element is obtained based on a particular frequency component of a sinusoidal wave, an integer multiple of periods of the sinusoidal wave matching the predetermined sample count, sampling an audio signal obtained as a result of capturing a sound in a space, at a predetermined timing according to the minimum sample unit equal to the sample count, and obtaining test results in terms of a predetermined test item from analysis results that are obtained by executing a predetermined frequency analysis on the audio signal sampled in the sampling step.

According to yet another aspect of the present invention, a computer program for causing a test apparatus to perform a test method includes steps of outputting, as a test sound source, a sound element according to a minimum output unit equal to a predetermined sample count expressed by a power of 2, wherein the sound element is obtained based on a particular frequency component of a sinusoidal wave, an integer multiple of periods of the sinusoidal wave matching the predetermined sample count, sampling an audio signal obtained as a result of capturing a sound in space, at a predetermined timing according to the minimum sample unit equal to the sample count, and obtaining test results in terms of a predetermined test item from analysis results that are obtained by executing a predetermined frequency analysis on the audio signal sampled in the sampling step.

A test sound is a sinusoidal wave, different from the pink noise.

The sinusoidal wave as the test sound is an integer multiple of periods thereof matching the predetermined sample count represented by the power of 2. The sampling unit samples the test sound emitted into space according to a sampling unit as the sample count. If the signal thus sampled is in an ideal state with only the sampled test signal contained therewithin, an amplitude value obtained as a result of a frequency analysis on the sampled signal contains theoretically a frequency of a main-lobe, and no side-lobe is generated. This means that it is not necessary to set a window function on generally unknown signal trains other than the test sound signal in an actual frequency analysis.

Since a sound having a pitch that can be sensed is heard as the test sound, different from the pink noise, the user is freed from uncomfortable sound. Since the process of using the window function is not required, the frequency analysis process is simplified. A computer program involved in the frequency analysis is also simplified accordingly, and an expansion in scale of hardware circuit for the frequency analysis is reduced. A highly reliable analysis result is achieved. Based on the reliable frequency analysis result, a reliable acoustic test is performed.

BRIEF DESCRIPTION OF THE DRAWINGS

FIG. 2 illustrates a concept of a production method of a sound element and a selection of a sound element adapted to a test melody;

FIG. 4 illustrates a concept of a production method of a sound element and a selection of a sound element adapted to a test melody actually implemented in one embodiment of the present invention;

DESCRIPTION OF THE PREFERRED EMBODIMENTS

The embodiments of the present invention are described below with reference to the drawings.

A test apparatus of one embodiment of the present invention is applied to an acoustic correction apparatus that corrects an acoustic field reproduced by a multi-channel audio system. The present invention is thus implemented in the test apparatus that tests acoustic characteristics of a listening environment including the audio system.

The acoustic correction apparatus of the embodiment is not the one originally contained in the audio system but an add-on unit to be added to an existing audio system. There is no particular limitation to the existing audio system as long as the existing audio system falls within a certain specification range.

If the audio system to be connected to the acoustic correction apparatus is unknown, a multi-channel scheme of that audio system is typically unknown as well.

The acoustic correction apparatus of the embodiment performs a pre-test measurement in a pre-test phase prior to a test. During the pre-test measurement, a channel configuration (speaker configuration) of a connected audio system is identified. In accordance with the results of the pre-test measurement, a signal level to be outputted from the speaker of each channel is determined during the test. An acoustic correction is performed on predetermined parameters in signal processing based on the test results obtained in the test.

The test sound is used in the pre-test measurement.

The concept of the test sound to be used in one embodiment of the present invention is described below with reference to FIG. 1.

Figure 1:
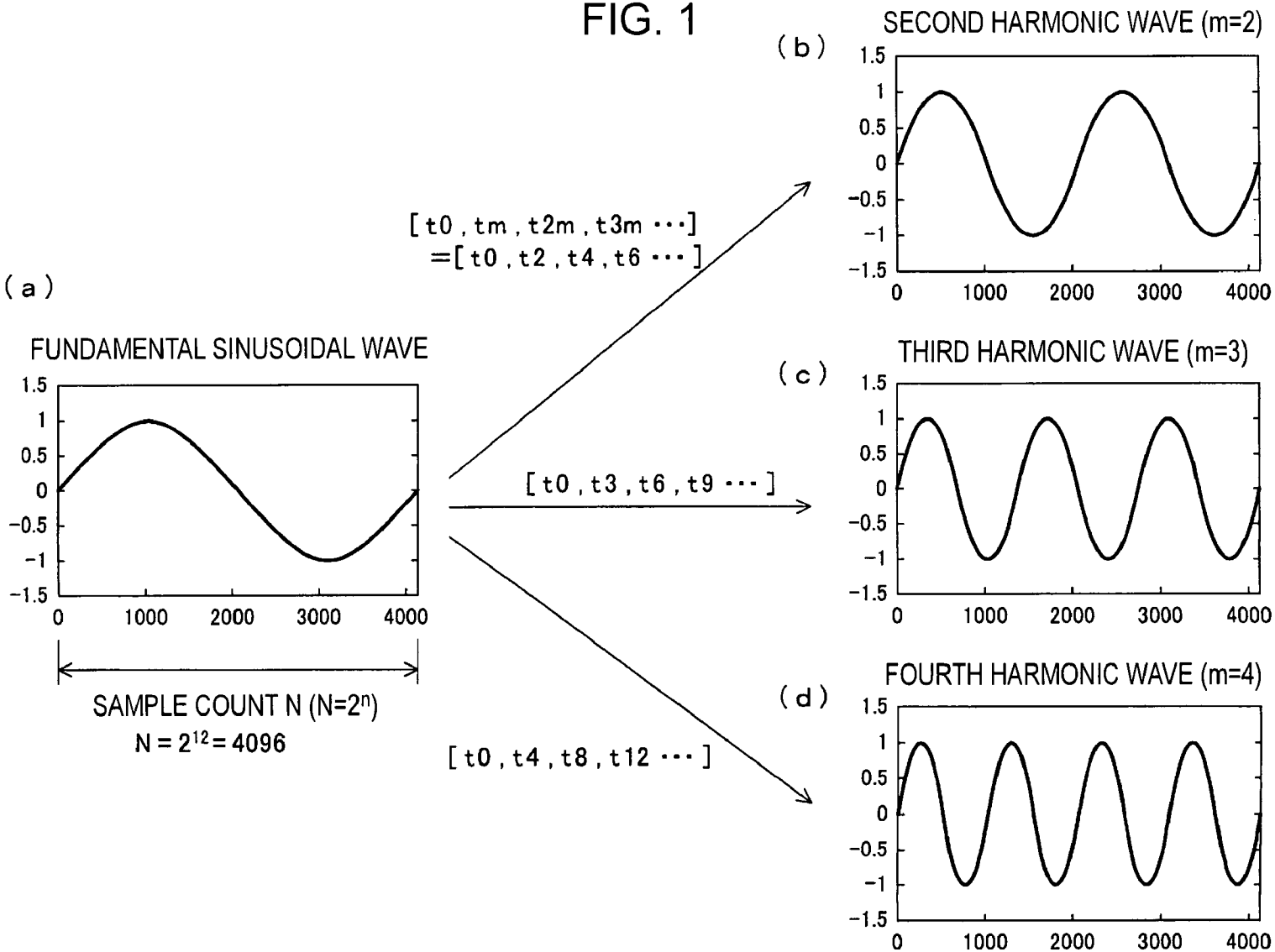
FIG. 1 illustrates a concept about a sound element serving as a factor of a test sound in accordance with one embodiment of the present invention.

In accordance with the present embodiment, a fundamental sinusoidal wave is defined as shown in FIG. 1. The fundamental sinusoidal wave is a particular one determined based on the condition that one period of the sinusoidal wave fits into a sample count N, where N is represented by a power of 2 (i.e., $2^n$, where "n" is a natural number).

The sample count N is not limited to any value as long as the sample count N equals to a power of 2. For convenience of explanation, N is 2 to the twelfth power (i.e., N=4096).

A sampling frequency Fs is 48 kHz. The frequency of the fundamental sinusoidal wave defined in the present embodiment is 48000/4096≅11.72 Hz. Here, 11.72 Hz is only an approximation, and for convenience of explanation, the frequency of the fundamental sinusoidal wave is regarded as 11.72 Hz in the following discussion.

Based on the fundamental sinusoidal wave, other sinusoidal waves are obtained as below.

Here, 4096 sample points corresponding to the sample count N (=4096) of the fundamental sinusoidal wave are designated with t0 through t4095 in time sequence. In accordance with the sample points t0-t4095 of the fundamental sinusoidal wave, 4096 samples at sample points t0, tm, t2*m*, . . . are collected. If it goes beyond t4095, the sample point starts with t0 again in circulation. In this way, another sinusoidal wave is generated.

If m=1, samples are collected at sample points t0, t1, t2, t4, t6 . . . , and a resulting sinusoidal wave becomes the fundamental sinusoidal wave itself. As shown in FIG. 1, a sinusoidal wave having a period half the period of the fundamental sinusoidal wave is obtained. In other words, the resulting sinusoidal wave has two periods in the sample count 4096.

Similarly, if m=3, sample points t0, t3, t6, t9, . . . are collected, resulting in a sinusoidal wave having three periods with reference to the fundamental sinusoidal wave as shown in FIG. 1. The resulting sinusoidal wave has three periods in the sample count 4096.

If m=4, sample points t0, t4, t8, t12, . . . are collected, resulting in a sinusoidal wave having four periods with reference to the fundamental sinusoidal wave as shown in FIG. 1. The resulting sinusoidal wave has four periods in the sample count 4096.

Generally speaking, in response to a variable m (m is an integer), sample points t0, tm, t2*m*, t3*m*, . . . are collected, thereby resulting in a sinusoidal wave having m periods in the sample count N (=4096).

In the following discussion, a sinusoidal wave having m periods in the sample count N is referred to as "m-th sinusoidal wave". The fundamental sinusoidal wave with m=1 is thus a first sinusoidal wave. In the present embodiment, the fundamental sinusoidal wave (m=1) is 11.72 Hz, a second sinusoidal wave has a frequency of 23.44 (=11.72×2) Hz, a third sinusoidal wave has a frequency of 35.16 (11.72×3) Hz, and the m-th sinusoidal wave has a frequency of 11.72×m Hz.

As is already known, the use of a sample count represented by a power of 2 is appropriate to process data when an input-output buffer in an input-output interface is arranged in a digital signal processor (DSP) or a central processing unit (CPU) or when a fast Fourier transform (FFT) is performed by the DSP or the CPU. For this reason, the sample count N is set to be a power of 2.

A frequency analysis, such as the FFT process, is performed on time series of the fundamental sinusoidal wave matching the sample count N (=4096) represented by the power of 2 to determine an amplitude of the fundamental sinusoidal wave. The amplitude has a value at only 11.72 Hz as the frequency of the m-th sinusoidal wave and has theoretically negative infinity at other frequencies on a logarithmic scale. In other words, if the frequency of 11.72 Hz is a main-lobe, a side-lobe arising from a frequency component contained in the main-lobe is not generated.

The same is true of an m-th sinusoidal wave equal to or higher than the second sinusoidal wave. This is because an integer multiple of periods of the m-th sinusoidal wave matches the sample count N as shown in FIG. 1.

Since the FFT process is performed on an unknown signal train in a manner free from the generation of side-lobes, the process of a window function other than a rectangular window becomes unnecessary.

In accordance with the present embodiment, a sound signal as a "sound element" generated based on the m-th sinusoidal wave is used as a test source sound for pre-test measurement. In other words, the sound signal as the "sound element" is reproduced as a test sound from the speakers in an audio system. When the test sound is outputted from the speakers, a sound signal picked up by a microphone is sampled as a response signal in the FFT frequency analysis process. As in the m-th sinusoidal wave, the sample count N and the sampling frequency Fs, applied to the response signal, are N=4096 and Fs=48 kHz, respectively.

If the test sound is outputted, and the picked up sound is sampled, and analyzed, a side-lobe corresponding to the frequency of the m-th sinusoidal wave is not generated. The frequency of the test signal, as the response signal, is accurately measured. If any amplitude in a frequency other than the test sound is obtained as a result of the frequency analysis, this is interpreted to mean that a level of background noise in the listening environment is measured because a side-lobe cannot be generated corresponding to the frequency of the m-th sinusoidal wave. Without the need for the process of the window function, the amplitude of the frequency component as a test sound and the amplitude of a frequency component considered as the background environment other than the test sound are clearly discriminated. For example, measurement results of the pre-test measurement are obtained from the comparison of the amplitude of the test sound and the amplitude of the background noise.

In the pre-test measurement, each speaker prepared to emit sound in the audio system outputs a sound element of an appropriately selected m-th sinusoidal wave as a test sound. The test sound is picked up and sampled for frequency analysis. Since the test sound is a sinusoidal wave in the present embodiment, the pitch thereof is easy to recognize to the human ears in comparison with the pink noise. In accordance with the present embodiment, the sound element of the m-th sinusoidal wave is outputted as the test sound, and in addition, sound elements (test sounds) obtained based on the m-th sinusoidal wave are combined in terms of time and pitch so that the human can hear the resulting output as a melody.

The user thus finds himself to listen to something like a melody, and is freed from uncomfortable listening to the pink noise. The degree of entertainment is thus increased.

To output a melodic test sound as an m-th sinusoidal wave, the sound element is produced in the present embodiment as described below.

In accordance with the present embodiment, a sound element for use as a melodic test sound shown in FIG. 2 is obtained.

As shown in FIG. 2, m=9 through 19 are selected as the variable "m" of the m-th sinusoidal wave. This range is determined taking into consideration a frequency easy to listen to within the human auditory sensation area, the number of desired pitches (determined depending on a melody to be produced, the number of sound elements appropriate as a test sound, and a sound range of the test sound), and performance of a device actually generating the sound element. The range of the variable "m" is described for exemplary purposes only, and another range of "m" is perfectly acceptable.

A frequency f obtained from the m-th sinusoidal wave is defined by the following equation:

$$f=(48000/4096)\times m\times 2^{k} \quad (1)$$

The frequency f with k=1 is defined as a base sound for each of 9th through 19th sinusoidal waves (m=9 through 19). As shown in FIG. 2, the base sound has 210.94 Hz for the ninth sinusoidal wave (m=9), 234.38 Hz for the tenth sinusoidal wave (m=10), 257.81 Hz for the eleventh sinusoidal wave (m=11), . . . , 421.88 Hz for the eighteenth sinusoidal wave (m=18), and 455.31 Hz for the nineteenth sinusoidal wave (m=19).

The frequencies of k-th harmonics (k is a integer variable equal to 2 or larger) correspond to the base sounds defined as above. Five frequencies f of harmonics k=2, k=3, k=4, k=5, and k=6 correspond to one base sound. In accordance with equation (1), the five frequencies f are k-th harmonics (hereinafter referred to as octave harmonics) having a frequency higher than the base sound (k=1) by a number of octaves represented by a difference (k−1). For example, the frequency of an octave harmonic wave with k=2 with respect to the frequency (210.94 Hz) of the base sound corresponding to the ninth sinusoidal wave (m=9) is 421.88 Hz, the frequency of an octave harmonic wave with k=3 is four times the frequency of the base sound, i.e., 843.75 Hz, . . . , and the frequency of an octave harmonic wave with k=6 is 32 times the frequency of the base sound, i.e., 6750.00 Hz. Thus, the frequencies are respectively higher than the frequency of the base sound by one octave, two octaves, . . . , five octaves.

In accordance with the present embodiment, levels of the octave harmonic waves (k=2 through 6) are set in a predetermined relationship with respect to the base sound (k=1), and one sound element is produced by synthesizing the octave harmonic waves from the base sound.

One sound element for use in the acoustic measurement is constructed of not only the frequency component of the base sound (k=1) but also the frequency component of an octave harmonic wave. By setting a level relationship of the frequency components, a tone of the sound element is set. Since a factor of tone is added to the test sound as a melody, namely, a combination of sound elements, a sequence of the sound elements outputted as the test sound becomes more like music.

If the sound element composed of the base sound (k=1) and the octave harmonic waves (k=2 through 6) is frequency analyzed, amplitudes of a total of six frequencies including the frequency of the base sound and the frequencies of the octave harmonic waves (k=2 through 6) is detected. When a plurality of frequencies are measured at the same time, the number of frequencies to be measured within a given frequency range increases, and a density of frequencies increases. Some speakers may feature a dip that a sound level in a particular frequency range sharply drops. If a frequency of the test sound falls within the range of dip in such a speaker, no sufficient amplitude is not observed as a result of analysis. No reliable test results are not obtained. Since the sound element of the test sound is produced by synthesizing different frequency components at the same time in accordance with the present embodiment, frequency components outside the dip range are observed with sufficiently large amplitude even if any given frequency component of the sound element falls within the dip range. Reliable test results are thus obtained.

For each of the octave harmonic waves with k≧2, an integer multiple of periods matches the sample count N. A rule that a waveform having an integer multiple of periods thereof matches the sample count N is thus applied to the octave harmonic waves.

The base sound is required as a factor forming the frequency component of the sound element, but all five octave harmonic waves falling within a range of 2≦k≦6 shown in FIG. 2 are not necessarily included in the sound element.

The sound element contains eleven different pitches respectively containing base sounds corresponding to orders m=9 through 19 as shown in FIG. 2. To make melodic an output sequence of the sound element as the test sound; the pitch (frequency) of each sound element has a tone difference corresponding to the musical scale of a given temperament.

A 12-tone equal temperament is now considered. The base sound of m=19 has a frequency of 445.31 Hz. If 445 Hz is set as a standard for a scale of an absolute term A, the base sound corresponding to the order m=19 is 445.313 Hz. Since a difference between the two sounds is small, the base sound of the order m of 19 can be regarded as the absolute term A.

If the base sound having a frequency of 445.313 Hz corresponding to the order m of 19 is used as the term A, base sounds falling within this scale are listed as follows:

- Base sound corresponding to the order m=10 (234.38 Hz)→A#
- Base sound corresponding to the order m=12 (281.25 Hz)→C#
- Base sound corresponding to the order m=15 (251.56 Hz)→F
- Base sound corresponding to the order m=16 (375.00 Hz)→F#
- Base sound corresponding to the order m=17 (398.44 Hz)→G
- Base sound corresponding to the order m=18 (421.88 Hz)→G#

If the frequency 445.313 Hz is regarded as term A, the tone of A# has a frequency of 235.896 Hz, the tone of C# has a frequency of 280.529, the tone of F has a frequency of 353.445 Hz, the tone of F# has a frequency of 374.462 Hz, the tone of G has a frequency of 396.728 Hz, and the tone G# has a frequency of 420.319 Hz as listed as equal temperament approximate frequencies in FIG. 2. The base sounds corresponding to the orders m of 10, 12, 15, 16, 17, and 18 are close to the equal temperament approximate frequencies of tones A#, C#, F, F#, G, and G#, respectively. These base sounds are thus regarded as the sounds of the tones A#, C#, F, F#, G, and G#, respectively.

As shown in FIG. 2, a sound element of an octave harmonic wave that is synthesized based on the base sound (234.38 Hz) corresponding to the order m of 10 is regarded as the tone A#, a sound element of an octave harmonic wave that is synthesized based on the base sound (281.25 Hz) corresponding to the order m of 12 is regarded as the tone C#, a sound element of an octave harmonic wave that is synthesized based on the base sound (351.56 Hz) corresponding to the order m of 15 is regarded as the tone F, a sound element of an octave harmonic wave that is synthesized based on the base sound (375.00 Hz) corresponding to the order m of 16 is regarded as the tone F#, a sound element of an octave harmonic wave that is synthesized based on the base sound (398.44 Hz) corresponding to the order m of 17 is regarded as the tone G, a sound element of an octave harmonic wave that is synthesized based on the base sound (421.88 Hz) corresponding to the order m of 18 is regarded as the tone G#, and a sound element of an octave harmonic wave that is synthesized based on the base sound (445.31 Hz) corresponding to the order m of 19 is regarded as the tone A.

In the application of outputting the test sound in a melody, it has been recognized that the musical scale composed of selected sound elements is not discordant in the auditory sensation of the human.

Figure 3A:
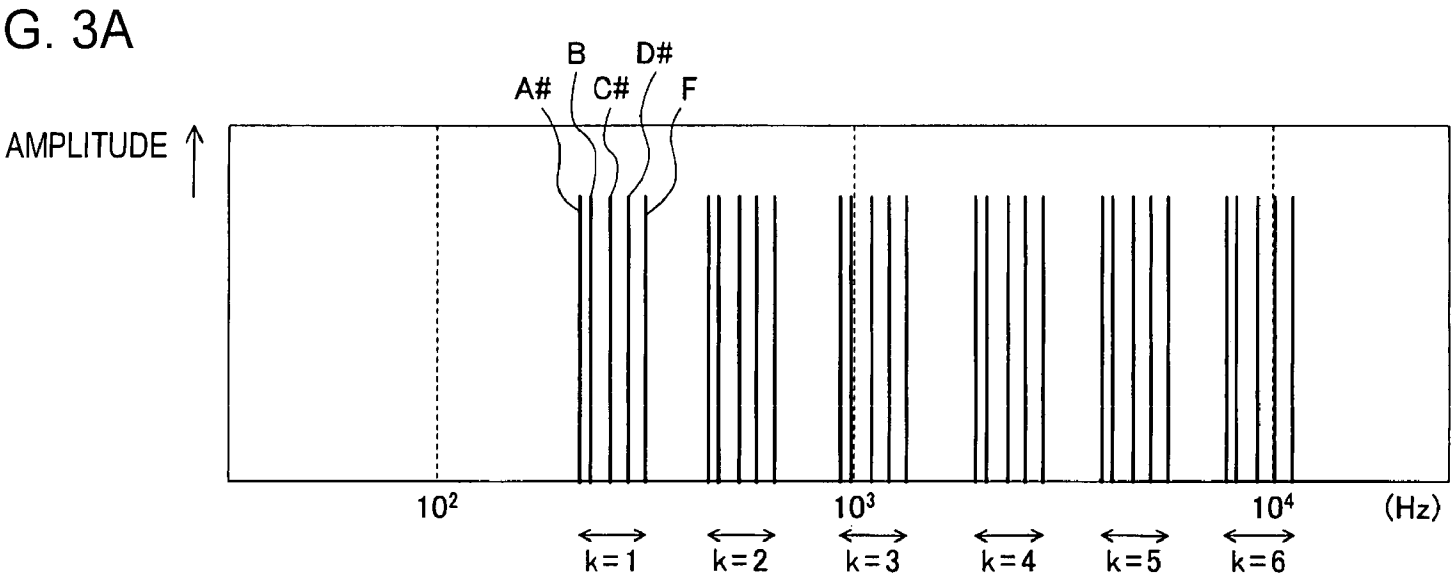
FIGS. 3A and 3B illustrate frequency characteristics of a sound element selected based on the concept of FIG. 2.
Figure 3B:
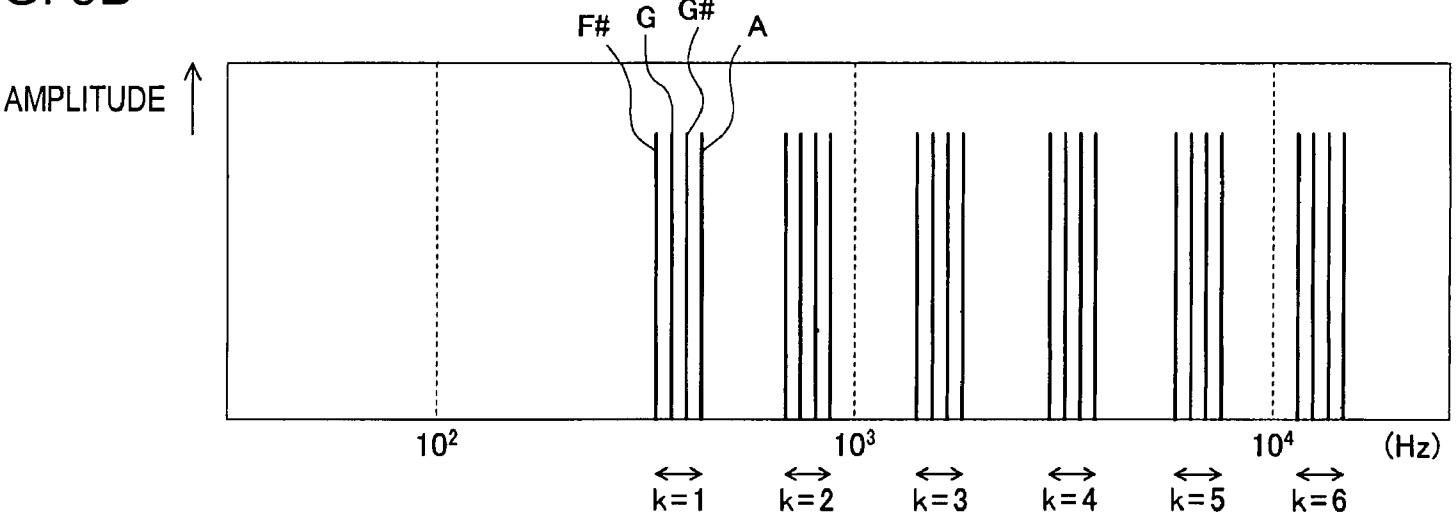

FIGS. 3A and 3B show frequency characteristics of the sound elements of the seven tones A#, C#, F, F#, G, G#, and A selected in a method described with reference to FIG. 2. As shown in FIG. 3, 42 (=7×6) test frequencies are substantially uniformly distributed in a test frequency range from 235.89.6 Hz of the base sound (k=1) corresponding to the tone A as the lowest frequency component to 14250.00 Hz of the octave harmonic wave (k=6) corresponding to the tone A as the highest frequency component. This means that the number of test frequencies present in the test range is necessary and sufficient, and that the presence of the test frequencies is not localized to a particular area in the test range. Regardless of the speaker dip previously discussed, stable and reliably test results are obtained.

The method of selecting the sound element in the present embodiment is based on the technique previously discussed with reference to FIG. 2. Only six tones A#, F, F#, G, G#, and A falling within about one octave, out of the 12-tone equal temperament, are used as previously discussed with reference to FIG. 2. The number of tones usable is preferably as many as possible in order to generate a melody using a sequence of sound elements as a test sound.

In accordance with the present embodiment, in practice, a technique illustrated in FIG. 4, based on the technique of FIG. 2, is used to determine sound elements usable to generate a melody as a test sound.

A sinusoidal wave having half the period of the fundamental sinusoidal wave of FIG. 1 is defined as a virtual fundamental wave. A virtual base sound of an m-th sinusoidal wave based on the virtual sinusoidal wave is defined as shown in FIG. 4.

A frequency f based on the m-th sinusoidal wave is expressed by equation (2):

$$f=(48000/4096)\times m\times 2(k-1) \quad (2)$$

The virtual base sound has a frequency f that is obtained by substituting k=0 in each m-th sinusoidal wave. A frequency that is obtained by substituting k=1 becomes a base sound, as previously discussed. With k=0 substituted in equation (2), the virtual base sound has half the frequency of the fundamental sinusoidal wave with k=1 ($2^{-1}$ equal to ½).

Based on the virtual base sound, 26 frequency candidates are distributed within a range from 105.469 Hz corresponding to m=18 to 251.953 Hz corresponding to m=43.

Octave harmonic waves have frequencies for k=1, k=2, k=3, k=4, k=5, and k=6 with respect to each virtual base sound (k=0).

The virtual base sound is an m-th sinusoidal wave corresponding to the virtual sinusoidal wave having twice the wavelength of the original fundamental sinusoidal wave shown in FIG. 1. An integer multiple of periods of an odd-order sinusoidal wave (with m being an odd number) based on the frequency of the virtual base sound fails to match the sample count N. The virtual base sound with k=0 is based on the virtual fundamental wave having twice the wavelength of the original fundamental wave. In an actual generation process, waveform data of the virtual sinusoidal wave is not used. The virtual base sound is not actually generated from the fundamental sinusoidal wave. In accordance with the present embodiment, the virtual base sound is excluded as a factor forming the actual sound element.

Octave harmonic waves with k=1 or higher are actually obtained as a factor of the sound element at each m order of the sinusoidal wave. The actual base sounds forming the sound element are octave harmonic waves of the fundamental wave with k=1 from among sinusoidal waves with k=1 through 6.

A list of the base sounds serving as the octave harmonic wave with k=1 shown in FIG. 4 is compared with a list of base sounds with k=1 shown in FIG. 2. In the list of FIG. 4, the virtual base sound having a frequency half the frequency of the original fundamental sinusoidal wave serves as a basis. In addition to the m-th order frequencies based on the base sound with k=1, the list of FIG. 4 thus includes base sounds present between the frequencies of FIG. 2. More specifically, the number of base sounds falling within a predetermined test range is almost doubled as shown in FIG. 4.

With the base sound of m=38 being 445.31 Hz, the tone A in the absolute term is defined as 445 Hz. In comparison of the frequency of the base sound (k=1) shown in FIG. 4 with the equal temperament approximate frequencies with A=445 Hz, the frequencies of the base sounds and the tones represented by the approximate absolute terms are associated to each other as below:

Base sound corresponding to the order m=19 (222.656 Hz)→A

Base sound corresponding to the order m=20 (235.896 Hz)→A#

Base sound corresponding to the order m=21 (249.923 Hz)→B

Base sound corresponding to the order m=24 (280.529 Hz)→C#

Base sound corresponding to the order m=27 (314.883 Hz)→D#

Base sound corresponding to the order m=30 (353.445 Hz)→F

Base sound corresponding to the order m=32 (374.462 Hz)→F#

Base sound corresponding to the order m=34 (396.728 Hz)→G

Base sound corresponding to the order m=36 (420.319 Hz)→G#

Base sound corresponding to the order m=38 (445.313 Hz)→A

Base sound corresponding to the order m=40 (466.164 Hz)→A#

Base sound corresponding to the order m=42 (493.883 Hz)→B

With the virtual base sounds defined in this way, 12 tones A, A#, B, C#, D#, F, F#, G, G#, A, A#, and B from low to high tone in the 12-tone equal temperament are used based on the frequencies of the octave harmonic wave having a frequency higher than the virtual base sound by one octave. In comparison with the technique of FIG. 2, the number of pitches of the sound elements for the melody production is thus increased.

As previously discussed with reference to FIG. 4, a single sound element can also be produced by synthesizing the octave harmonic waves with k=2 through 6 based on the base sound with k=1 in each of 12 tones.

The virtual base sound is a sinusoidal wave having the frequency (f) of the m-th sinusoidal wave with k=0 substituted in equation (2). In the principle of the present invention, the virtual base sound is not limited to the sinusoidal wave having half the frequency of the fundamental wave with reference to the m-th sinusoidal wave of the fundamental sinusoidal wave as shown in FIG. 4. More specifically, the virtual base sound has a frequency of an m-th sinusoidal wave that is obtained by substituting any negative natural number k smaller than 0. The base of the virtual base sound (m=1) contains a frequency equal to $½^P$ of the fundamental sinusoidal wave shown in FIG. 1 (P is a natural number).

Figure 5:
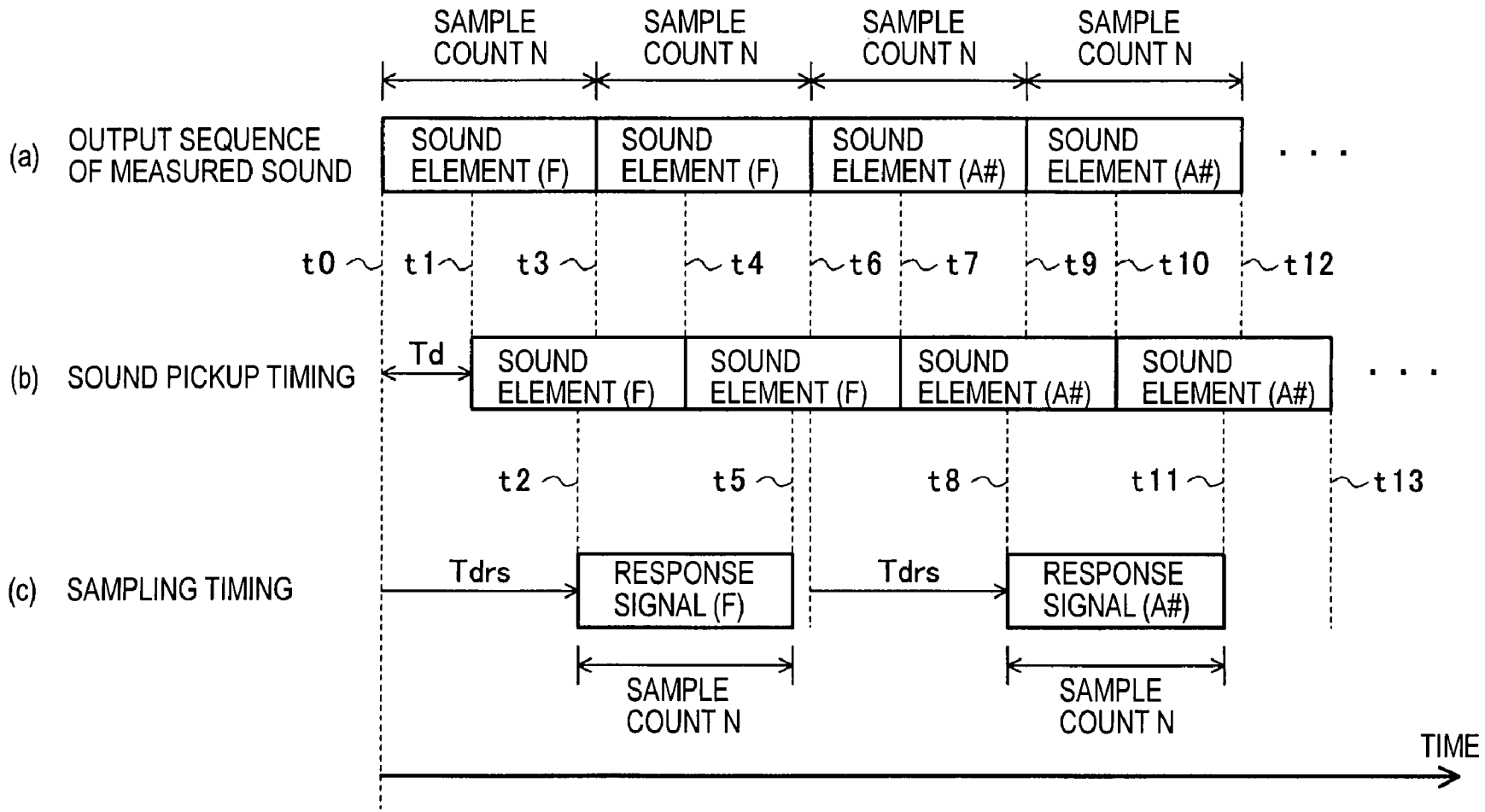
FIG. 5 is a timing diagram illustrating a measured sound output and a basic sequence of sampling in accordance with one embodiment of the present invention.

FIG. 5 diagrammatically illustrates a basic test sound output sequence of a sound element selected as a melodic test sound.

The test sound output sequence shown in FIG. 5 is a timing for outputting the sound element as the test sound to an audio signal output system to emit the sound element from a speaker.

In period t0-t3 and period t3-t6, the sound element as the test sound corresponding to the pitch F is outputted twice consecutively. Since a single sound element contains a frequency component of a sinusoidal wave having an integer multiple of periods thereof matching the sample count N, the output periods of the single sound element (periods t0-t3 and t3-t6) also match the sample count N in time sequence.

After the end of the output of the sound element of the pitch F at time t6, the sound element corresponding to the pitch A# is outputted twice in periods t6-t9 and t9-t12.

The sound element of the single fundamental wave is outputted by looping a signal of the sample count N twice.

With the sample count N=4096, and the sampling frequency Fs=48 kHz, the duration of time corresponding to the sample count N is 4096/48000≅0.085 (second).

The sound of the sound element emitted from the speaker into space reaches a microphone arranged at a pickup position at a pickup timing shown in FIG. 5. The arrival sound is thus picked up by the microphone.

The comparison of the pickup timing with the test sound output sequence shown in FIG. 5 reveals that, at time t1 after delay time of Td subsequent to time t0, a microphone starts picking up the sound element outputted as the test sound at time t0. The delay time Td contains a system delay time caused from the inputting of the sound element to an audio signal output system to the emission of the audio signal from a speaker, and a spatial propagation delay time caused, in accordance with a distance between the speaker and a microphone, from the emission of the sound from the speaker to the arrival of the sound to a microphone.

As shown in FIG. 5, pickup timings of the pitch F are in period t1 through t7. The time length from t1 to t7 as the pickup period corresponds to an output period t0 to t6 of the sound element as the pitch F. The pickup period from t1 to t7 is divided into two period segments t1-t4 and t4-t7. Each segment corresponds to the sample count N.

The pickup timings of the sound element of the pitch A# falls within a period from t7 to t13. The period t7 to t13 is also divided into two segments t7 to t10 and t10 to t13.

To measure the audio signal picked up by the microphone, the audio signal is sampled into a response signal. Such sampling timings are shown in FIG. 5. The sound element corresponding to the pitch F, outputted with the sample count N repeated twice during the period t0 to t6, is sampled at time t2 with sample delay time Tdrs subsequent to time t0 as an output start timing of the pitch F. A sampling operation starting at time t2 ends at time t5 after time elapse corresponding to the sample count N from time t2. In other words, the sampling operation is performed in accordance with the sample count N. The timings in period t2 to t5 fall within a period t1 to t7 throughout which an audio of the sound element corresponding to the pitch F is picked up. In the sampling operation in the period t2 to t5, sampling data of the sample count N is obtained from the sound element corresponding to the pitch F.

As in the pitch F, the next sampling timing starts at time t8 subsequent to a sample delay time Tdrs from time t6 at the output start time of the sound element corresponding to the pitch A#. At time t11, the sampling operation of the sample count N is completed. Sampling data of the sample count N is obtained from the sound element corresponding to the pitch A# outputted during the period t6 to t12.

The sample delay time Tdrs in FIG. 5 corresponds to a duration of time from the output start of one sound element to the start of the sampling period for obtaining the sampling data of the sound element, and thus determines the timing of the sampling period.

The sample delay time Tdrs is set so that only the sound element to be tested is reliably sampled. For example, as for the sound element corresponding to the pitch F of FIG. 5, only the sound element corresponding to the pitch F is reliably sampled during the sampling period t2 to t5. The sampling period is thus set to reliably fall within the period t1 to t7 so that no sound element other than the target sound element may be picked up. For example, no sampling operation is performed when no test sound is available prior to time t1 or when the sound element corresponding to the pitch A# to be picked up subsequent to time t7 is not picked up. Even if the sampling period t8 to t11 is set for the sound element corresponding to the pitch A#, the sample delay time Tdrs equal to the counterpart for the sound element corresponding to the pitch F is set. During a period t7 to t13, an audio signal is picked up, and only the sound element corresponding to the pitch A# is acquired as a target.

In practice, the sample delay time Tdrs is determined by estimating a delay time Td expected in an environment under which the acoustic correction apparatus of the present embodiment is used. The sample delay time Tdrs is set based on the determined delay time Td. For example, if the acoustic correction apparatus is intended for use as an automobile audio system, the delay time Td is determined from a typically available automobile interior environment.

The audio signal sampled during the sampling period t2-t5 extends over a first half and a second half of the sample count N with a border at t4 as a continuation point of the sample count N. Since the sampling operation is performed for the sample count N, only a frequency component having an integer multiple of periods thereof fitting into the sample count N is obtained as the sampling data. In other words, frequency analysis results provide a frequency of a main-lobe free from side-lobe. If non-target sound element is sampled in the sampling operation for the sample count N, a side-lobe is caused. For example, if time t7 is included in the sampling period from t2 to t5 in FIG. 5, the sound element corresponding to the pitch F is sampled for a first half, and the sound element corresponding to the pitch A# is sampled for a second half.

This shows that the output period of the sound element needs to be longer than the corresponding sampling period. In accordance with the present embodiment, each of the output period of the sound element and the sampling period has the sample count N as a minimum unit in time sequence. Furthermore, the above-referenced relationship between the sampling period and the output period of the sound element is satisfied. If N×a represents the sampling period ("a" is a natural number), the output period of the sound element becomes N×(a+b) ("b" is a natural number equal to or lager than 1).

Figure 6:
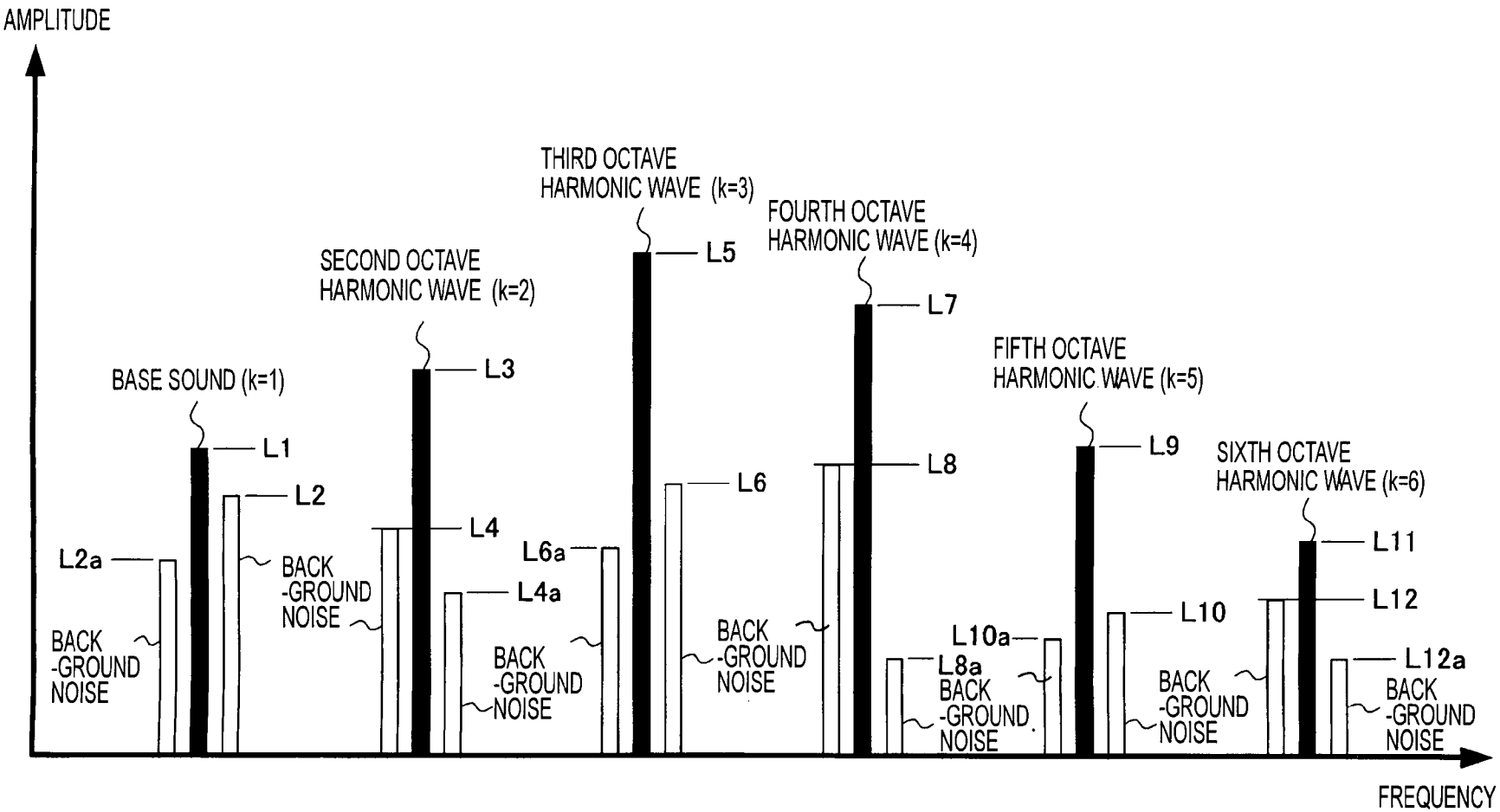
FIG. 6 is a plot of a frequency analysis result of a response signal in accordance with one embodiment of the present invention.

FIG. 6 diagrammatically illustrates bandwidth characteristics that are obtained when FFT frequency analysis is performed on the response signal sampled in accordance with the procedure of FIG. 5. A single sound composed of only the sound element corresponding to a single pitch is sampled and FFT analyzed.

When the target test sound of the sound element of the single sound is sampled and FFT analyzed, amplitude values of a base sound (k=1), a second octave harmonic wave (k=2), a third octave harmonic wave (k=3), a fourth octave harmonic wave (k4), a fifth octave harmonic wave (k=5), and a sixth octave harmonic wave (k=6) can result.

In accordance with the present embodiment, the test sound having the sound element of the sinusoidal wave with an integer multiple of periods thereof matching the sample count N is outputted and picked up, and the audio signal of the picked up sound element is sampled at the sample count N. If the sampling data is an ideal audio signal composed of only the sound element, the target test frequency forming the sound element contains a value as a main-lobe with no side-lobe generated as a result of the FFT frequency analysis.

In the actual FFT frequency analysis result of FIG. 6, amplitudes are detected at frequencies on both sides of each of the target test frequencies of the base sound and the octave harmonic waves. If the FFT frequency analysis is performed on the signal of only the sound element, no amplitude has to be present at frequencies other than the frequency forming the sound element. The amplitude at a frequency other than the target test frequency is considered to be a background noise in a test environment. As previously discussed, the analysis result is obtained without performing the window function process.

Based on the analysis result of FIG. 6, a ratio of a level of the target test frequency to a level of the background noise present at adjacent frequencies is determined. An S/N ratio is here determined where "S" represents a signal having an amplitude at the target test frequency, and "N" represents the amplitude of the background noise.

A technique for calculating the S/N ratio is not limited to any particular one as long as calculation is based on the amplitude at the target test frequency and the amplitude of the background noise. For example, the noise level to be compared with the level of the target test frequency is the one having the highest amplitude at a frequency among frequencies adjacent to each target test frequency. As shown in FIG. 6, the base sound has an amplitude value of L1. The background noise at the adjacent frequencies includes an amplitude L2*a* at a frequency lower than the base sound and an amplitude L2 higher in level than the amplitude value L2*a* on a frequency higher than the base sound. The amplitude L2 of the background noise is used to calculate the S/N ratio. For example, L2/L1 is calculated to determine the S/N ratio.

Similarly, the calculation of the S/N ratio is performed on each octave harmonic wave in addition to the base sound. Information of the S/N ratio of the six target frequency bands of the base sound and the second through sixth harmonic waves is thus obtained.

In another technique to obtain the S/N ratio, the amplitude value at each target frequency is logarithmically weighted, and then compared with the amplitude value of the noise frequency. A weight coefficient can be modified on a per target frequency basis in accordance with a predetermined rule.

The amplitude values of the noise at frequencies adjacent to the target frequency are averaged, and the S/N ratio is calculated based on the mean value and the amplitude value of the target frequency.

In the calculation of the S/N ratio, the amplitude value may be compared in a linear axis rather than in dB axis.

In accordance with the technique discussed with reference to FIG. 4, the sound elements corresponding to 12 pitches are obtained to output a melodic test sound. When a melody by the test sound (a test sound melody) is actually produced, sound elements corresponding to any pitches from among the 12 pitches are selected and combined.

Figure 7:
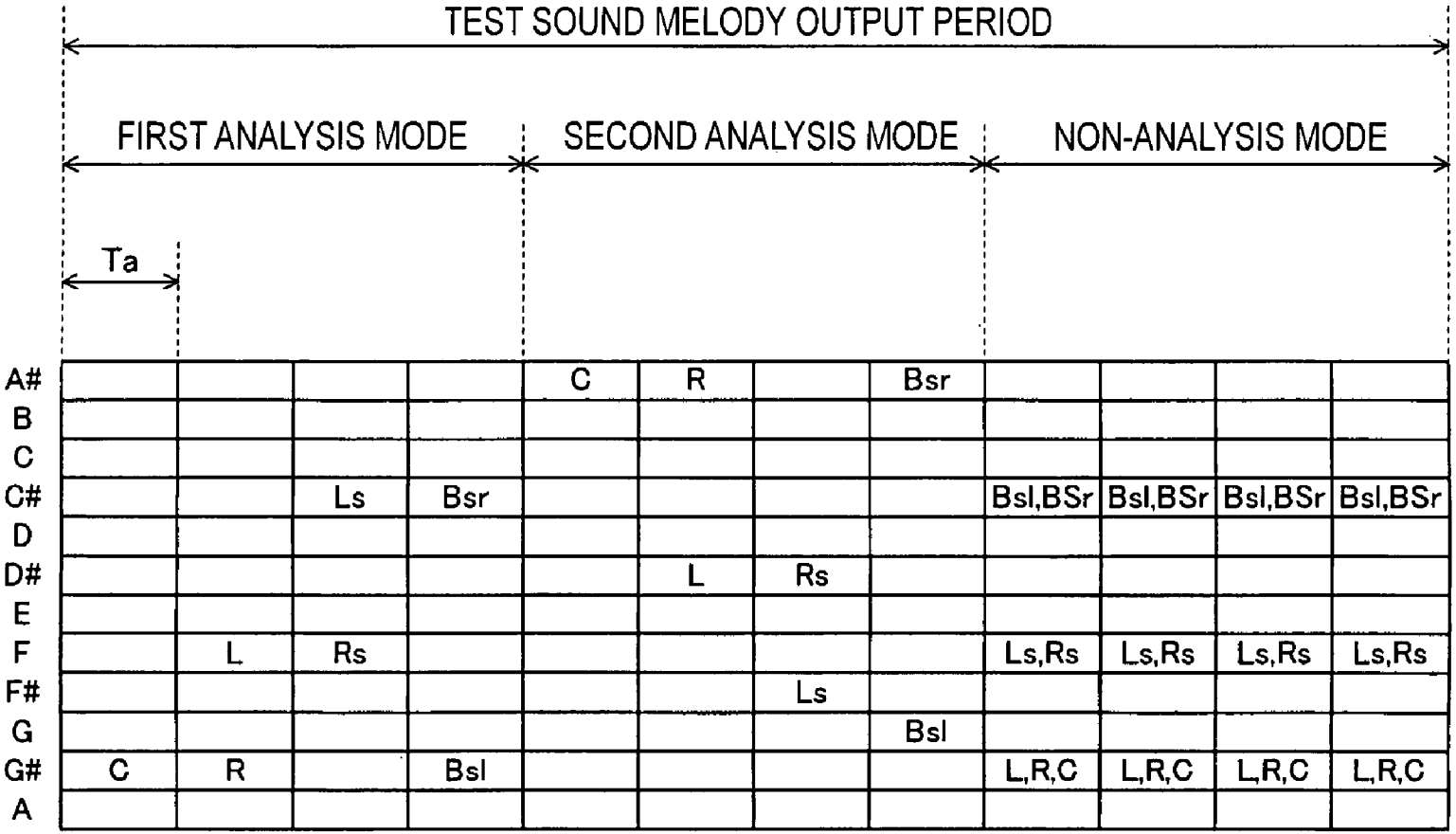
FIG. 7 illustrates an output pattern of the test melody in accordance with one embodiment of the present invention.

FIG. 7 illustrates an output pattern of the sound element of a test sound melody that is selected as a candidate as a sound element corresponding to each of the 12 pitches using the technique described with reference to FIG. 4.

The test sound melody output period of one unit shown in FIG. 7 is segmented into a first analysis mode, a second analysis mode, and a non-analysis mode in the order of time sequence. One output period Ta of the sound element equals two consecutive repetitions of the sample count N as previously discussed with reference to FIG. 5. If the sample count N=4096 and the sampling frequency Fs=48 kHz, time of the output period Ta here is calculated as follows:

$$4096/48000\times2=0.17 \text{ (second)}$$

The sampling timing (sampling period) corresponding to the output of the test sound melody also depends on the sample count N as previously discussed with reference to FIG. 5, and the sample delay time Tdrs determined as previously discussed with reference to FIG. 5. The sampling timing is set herein so that only the sound element outputted during each output period Ta is sampled and so that any sound element outputted subsequent to and prior to the output period Ta is not sampled.

FIG. 7 shows target speaker channels that are selected to output the sound of the sound element during the output period Ta. The speaker channels include a center channel (C), a front left channel (L), a front right channel (R), a left surround channel (Ls), a right surround channel (Rs), a left back surround channel (Bsl), and a right back surround channel (Bsr). The acoustic correction apparatus of the present embodiment is a seven-channel audio system with a maximum of seven channels.

In the output sequence of the test sound of FIG. 7, the output period Ta is consecutively repeated by four times in the first analysis mode. During a first output period Ta, only the sound element corresponding to the pitch G# is outputted through the center channel (C). During a second output period Ta, the sound element corresponding to the pitch F and the sound element corresponding to the pitch G# are outputted through the front left channel (L) and the front right channel (R), respectively. During a third output period Ta, the sound element corresponding to the pitch C# and the sound element corresponding to the pitch F# are outputted through the left surround channel (Ls) and the right surround channel (Rs), respectively. During a fourth output period Ta, the sound element corresponding to the pitch C# and the sound element corresponding to the pitch G# are outputted through the left back surround channel (Bsl) and the right back surround channel (Bsr), respectively.

During the second analysis mode, the output period Ta is consecutively repeated by four times. For each output period Ta, the sound element corresponding to the particular pitch is outputted through the particular speaker channel as listed in FIG. 7.

In accordance with the output sequence of FIG. 7, a test sound of any pitch (sound element) is outputted through the speaker of each of the seven channels in each of the first analysis mode and the second analysis mode. All speakers are tested in the first analysis mode and the second analysis mode in the channel configuration to which the acoustic correction apparatus is adaptable.

During some output periods Ta, different pitch sound elements are emitted from a plurality of speakers, thereby creating a summational tone in space. In accordance with the present embodiment, a desired output pattern is produced by combining the sound element in time and musical scale to output a musical test sound.

Even if the output of the sound element as the test sound is in a summational tone, a test process is performed without any problem. When a picked up sound is FFT frequency analyzed, the amplitude of a frequency component (the base sound and the octave harmonic wave) forming each sound element of the summational tone is obtained.

Since a summational tone is outputted for some output period Ta, the melody formed of the test sound sounds like more music, and thus entertains more the user.

During the first analysis mode, the level of the sound element to be outputted from each speaker during the second analysis mode is determined based on the frequency analysis result of the sound element outputted from each speaker in the first analysis mode. During the second analysis mode, the test sound (sound element) is outputted through each speaker at the level appropriate for the pre-test measurement. Even during the second analysis mode, the sound element outputted from each speaker as shown in FIG. 7 is FFT frequency analyzed. Based on the analysis results, pre-test measurement data is obtained.

The amplitude value of the test frequency and the S/N ratio calculated based on the amplitude value of the background noise present at the frequencies adjacent to the target frequency, as previously discussed with reference to FIG. 6, may be used to obtain the measurement results in the first analysis mode and the second analysis mode. A variety of determinations and settings may be performed in the measurement results based on the S/N ratio.

Reproduction frequency band characteristics of each speaker are estimated by generally using the S/N ratio of each frequency component forming the sound element outputted through the speaker. Since an output sound pressure level of each speaker responsive to a constant input level varies depending on the diameter of the speaker, the diameter of the speaker is thus estimated. Even if a sound of a sound element is outputted with sufficient gain from a given speaker, the S/N ratio as a result of analyzing a response signal of a sound element may be lower than a predetermined level and no substantial signal level may result. In such a case, that speaker is determined as being unconnected. In other words, the audio channel configuration of the audio system can be estimated.

The present embodiment is applied to the pre-test measurement at a phase prior to a test. To obtain an accurate frequency response in the pre-test measurement, the level of an appropriate test sound (in this case, the test sound is not limited to the sound element of the present embodiment) may be estimated and set. A process in the first analysis mode may include setting a synthesis balance and an output level (gain) of the frequency components of the sound elements to be outputted from each speaker during the second analysis mode.

If the S/N ratio is lower than a predetermined level in response to a large noise amplitude, the test environment may be determined to be too unreliable to test the audio system. In response to such a determination result, the acoustic correction apparatus may present a message prompting the user to improve the listening environment.

In the non-analysis mode in succession to the second analysis mode shown in FIG. 7, the sound element corresponding to the pitch C# is outputted through each of three speakers of the center channel (C), the front left channel (L), and the front right channel (R) throughout four repetitions of the output period Ta. Concurrently, the sound element corresponding to the pitch F is outputted through each of speakers of the left surround channel (Ls) and the right surround channel (Rs), and the sound element corresponding to the pitch C# is outputted through each of speakers of the left back surround channel (Bsl) and the right back surround channel (Bsr).

During the non-analysis mode, the response signal-responsive to the output sound element is not sampled. In other words, the frequency analysis and the measurement are not performed on the output sound element during the non-analysis mode.

The acoustic correction apparatus consecutively functions in the first analysis mode, the second analysis mode, and the non-analysis mode during the test sound melody output period. Referring to the sound element output pattern of FIG. 7, the sound outputted from the seven channel speakers during the output period Ta is a melodic tone with the output period Ta as a minimum musical note. During the non-analysis mode, the three pitches G#, F, and G# are outputted in whole note, thereby resulting an ending of the melody. The non-analysis mode is not used to test the audio system, but to output the sound element to make the test sound melody more like music. In accordance with the present embodiment, all response signals of the sound elements outputted from the speakers are not necessarily sampled and analyzed.

Figure 8:
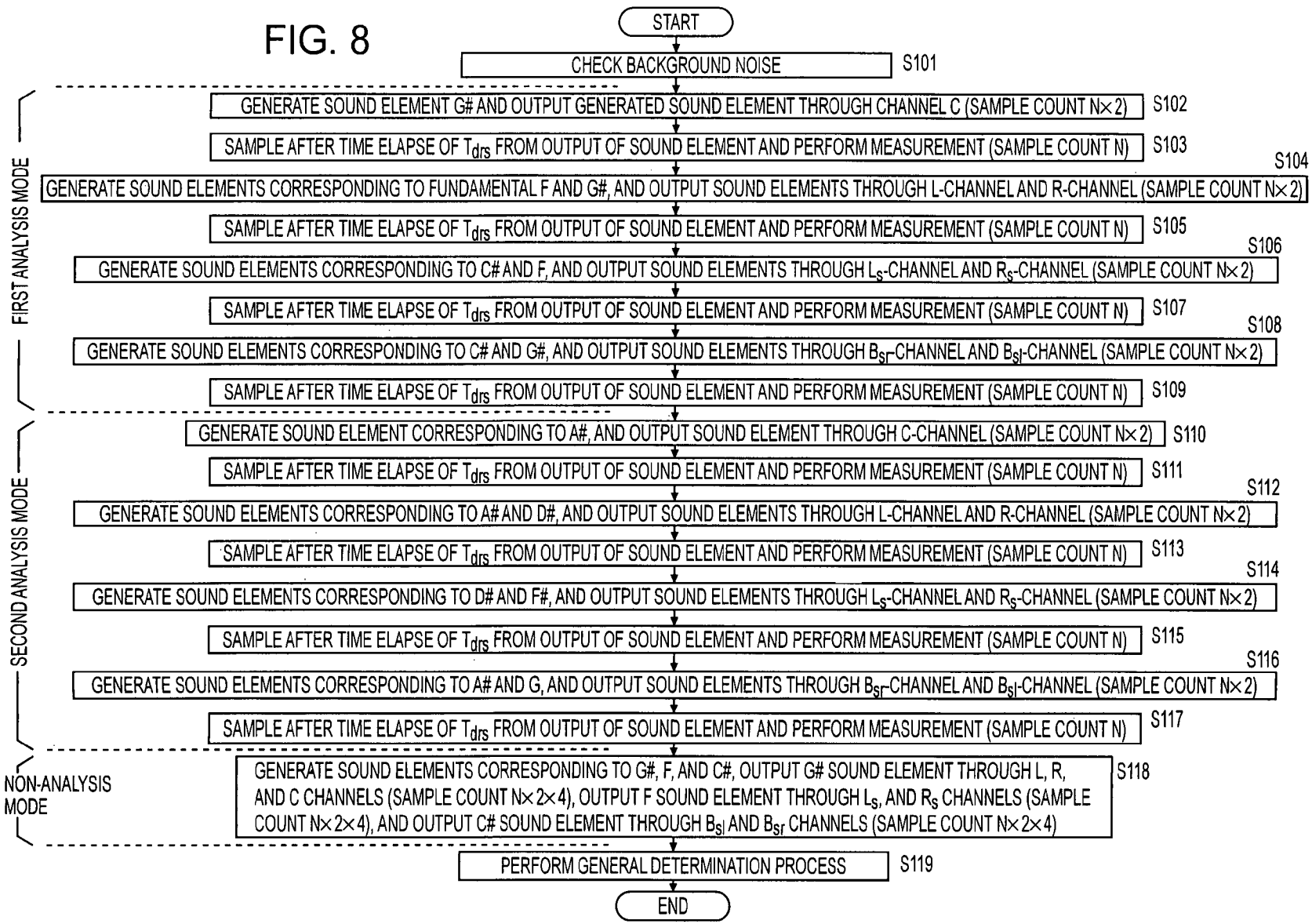
FIG. 8 is a flowchart of the sound element production, the output process of the sound element, analysis, and test process in accordance with the output pattern of the test melody of FIG. 7.

FIG. 8 is a flowchart of the pre-test measurement performed in accordance with the output sequence of the test sound melody of FIG. 7.

In step S101, the background noise is checked. No sound element is outputted during the background noise check. Any sound picked up by the microphone is sampled and FFT analyzed. The presence or absence of the background noise is thus checked by monitoring the amplitude of the background noise. At least some level of any background noise is present under a typical listening environment. If the background noise check in step S101 shows the absence of any background noise, the acoustic correction apparatus may display an on-screen message or present a voice message, prompting the user to connect the microphone to the acoustic correction apparatus. If it is determined in step S101 that a background noise is present, the microphone is considered to be connected. The process proceeds to step S102.

Step S102 corresponds to the first output period Ta of the first analysis mode. In other words, the sound element corresponding to the pitch G# is outputted through the speaker of the center channel (C). The sound element of the pitch G# of the sample count N is generated. The sound element thus generated is looped twice consecutively. The audio signal as the sound element corresponding to the pitch G# is reproduced and outputted during a time length equal to twice the sample count N, namely, a time length equal to the output period Ta.

In step S103, a measurement process in the first analysis mode is performed on the sound element outputted in step S102. More specifically, the sampling operation is performed to obtain a response signal at a timing at the elapse of the sample delay time Tdrs from the output timing of the sound element in step S102. The response signal is FFT frequency analyzed to calculate the S/N ratio as previously discussed with reference to FIG. 6. In response to the S/N ratio, a predetermined determination or setting is performed. The measurement process in the first analysis mode is performed to obtain the measurement results. For example, since the response signal obtained in step S103 is the one output from the speaker of the center channel (C), audio gain setting is performed during the next second analysis mode in accordance with the sound pressure level of the test sound outputted from the speaker of the center channel (C).

Step S104 corresponds to the second output period Ta in the first analysis mode. As in step S102, the two sound elements (each having the sample count N) corresponding to the pitches F and G# are generated, then looped twice, and then outputted through the front left channel (L) and the front right channel (R), respectively.

In step S105, as in step S103, the sound elements outputted in step S104 are sampled, and the measurement process in the first analysis mode is performed. The measurement results are thus obtained.

Step S106 corresponds to the third output period Ta in the first analysis mode. As in step S102, the two sound elements (each having the sample count N) corresponding to the pitches C# and F are generated, looped twice, and then outputted through the left surround channel (Ls), and the right surround channel (Rs), respectively.

In step S107, as in step S103, the sound elements outputted in step S106 are sampled, and the measurement process in the first analysis mode is performed. The measurement results are obtained.

Step S108 corresponds to the fourth (last) output period Ta in the first analysis mode. In step S108, as in step S102, the two sound elements (each having the sample count N) corresponding to the pitches C# and G# are generated, looped twice, and outputted through the speakers of the left back surround channel (Bsl) and the right back surround channel (Bsr), respectively.

In step S109, as in step S103, the sound element outputted in step S105 is sampled, and the measurement process in the first analysis mode is performed. The measurement results are thus obtained.

With step S109 completed, the measurement results of the seven audio channels are obtained during the first analysis mode. More specifically, the gain of the audio signal to be outputted from the speakers of the audio channels during the second analysis mode is already set.

Steps S110 through S117 are performed during the second analysis mode. S110 corresponds to the first output period Ta in the second analysis mode. In step S110, as in step S102, the sound element corresponding to the pitch A# is generated, looped twice, and outputted.

In step S111, as in step S103, the sound element outputted in step S110 is sampled into a response signal. The response signal is then FFT frequency analyzed. The measurement process is performed based on the FFT frequency analysis results. In the measurement process, the S/N ratio calculated from the amplitude values of the target frequency and the background noise acquired in the FFT frequency analysis are used. The acoustic correction apparatus determines whether a speaker having outputting the sound element (test sound) (for the center channel in step S111) is present. If it is determined that a speaker having outputted the sound element is present, the sound pressure level, namely, the signal level of the test sound, to be outputted from the center channel during the test is set. In this setting, a determination of whether the sound signal outputted from the speaker is clipped is also used.

Step S112 corresponds to the second output period Ta in the second analysis mode. In step S112, as in step S102, the two sound elements (each having the sample count N) corresponding to the pitches D# and A# are generated, looped twice, and outputted through the front left channel (L) and the right front channel (R), respectively.

In step S113, as in step S13, the sound elements outputted in step S112 are sampled, and the measurement process for the second analysis mode is performed. The measurement results are thus obtained.

Step S114 corresponds to the third output period Ta for the second analysis mode. In step S114, as in step S102, the two sound elements (each having the sample count N) corresponding to the pitches F# and D# are generated, looped twice, and outputted through the left surround channel (Ls) and the right surround channel (Rs).

In step S115, as in step S103, the sound elements outputted in step S114 are sampled, and the measurement process for the second analysis mode is performed. The measurement results are thus obtained.

Step S116 corresponds to the fourth (last) output period Ta in the second analysis mode. In step S116, as in step S102, the two sound elements (each having the sample count N) corresponding to the pitches G and A# are generated, looped twice, and outputted through the left surround channel (Ls) and the right surround channel (Rs), respectively.

In step S117, as in step S103, the sound elements outputted in step S116 are sampled, and the measurement process for the second analysis mode is performed. The measurement results are thus obtained.

The outputting of the test sound, the acquisition of the response signal through the sampling process, and the FFT frequency analysis in the second analysis mode are now complete. For example, the acoustic correction apparatus determines whether each of the seven channel speakers is present (i.e., the audio channel configuration of the audio system). Furthermore, the output level of the test sound for the test is also set.

In accordance with the test sound output sequence of FIG. 7, step S118 corresponding to the non-analysis mode is performed in succession to the second analysis mode. More specifically the sound elements corresponding to the pitches G#, F, and C# are produced. The sound element corresponding to the pitch G# is outputted through each of the speakers of the center channel (C), the front left channel (L), and the front right channel (R). The sound element corresponding to the pitch F# is outputted through each of the speakers of the left surround channel (Ls), and the right surround channel (Rs). The sound element corresponding to the pitch C# is outputted through each of the speakers of the left back surround channel (Bsl) and the right back surround channel (Bsr). These sound elements of the pitches are outputted concurrently at the timing of the output period Ta. As shown in FIG. 7, the output period Ta is repeated by four times. Accordingly, two consecutive repetitions of the sample count N are repeated by four times.

The non-analysis mode in step S118 for the test sound outputting is followed by step S119 where a general determination process is performed in response to the analysis and measurement results. Until now, the analysis and measurement processes are performed on the sound elements, outputted within the output period Ta, on an individual basis. Even if a measurement error occurs in any of the channels, the error cannot be identified based on the analysis and measurement performed on that channel alone.

In step S119, all analysis results and measurement results are compared to each other to identify the presence or absence of a local error. Taking into consideration of the balance of the parameters set in each channel, the parameters may be updated for optimum setting.

Figure 9:
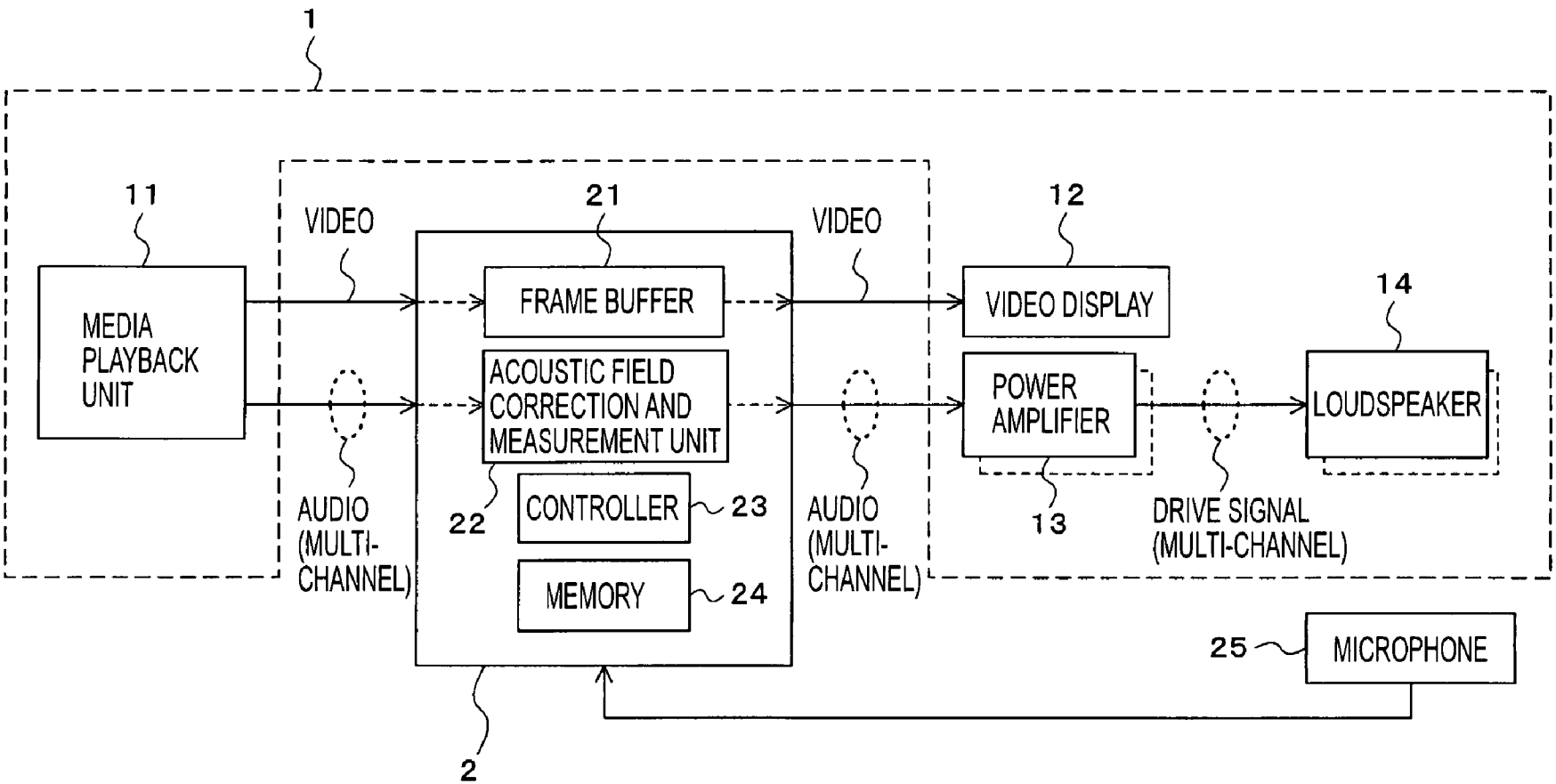
FIG. 9 is a block diagram illustrating a general integration including an acoustic correction system and an audio-visual system in accordance with one embodiment of the present invention.

FIG. 9 illustrates a general system 1 including the acoustic correction apparatus 2, and the audio system connected to the acoustic correction apparatus. As previously discussed, the acoustic correction apparatus 2 is an add-on unit to the existing system, and is compatible with any audio system within a certain specification range. As shown in FIG. 9, the audio-visual system 1 that replays both audio and video includes the audio system connectable to the acoustic correction apparatus 2.

The AV system 1 includes a media playback unit 11, a video display 12, a power amplifier 13, and a loudspeaker 14.

The media playback unit 11 reproduces data as audio and video contents recorded on a medium, thereby outputting a digital video signal and a digital audio signal.

The type and format of media working on the media playback unit 11 are not limited to any particular ones. For example, the medium may be a digital versatile disk (DVD). In the case of the DVD, the media playback unit 11 reads data as video and audio contents recorded on a DVD loaded therein, thereby acquiring video data and audio data. In the currently available DVD format, the video data and the audio data are encoded (compressed) in accordance with DVD standards, and the media playback unit 11 decodes the video data and the audio data. The media playback unit 11 outputs decoded digital video data and decoded digital audio data.

The media playback unit 11 may be multi-media compatible to playback an audio CD. Furthermore, the media playback unit 11 may be a television tuner for receiving and demodulating a television signal and outputting a video signal and an audio signal. The media playback unit 11 may have a television tuner function and a playback function of package media.

When the media playback unit 11 works with multi-audio channels, the playback audio signals may be outputted via a plurality of signal lines corresponding to the audio channels.

The media playback unit 11 outputs the audio signals via seven lines for the respective channels if the media playback unit 11 is compatible with the center channel (C), the front left channel (L), the front right channel (R), the left surround channel (Ls), the right surround channel (Rs), the left back surround channel (Bsl), and the right back surround channel (Bsl) as shown in FIG. 7.

If the AV system 1 alone is used, the video signal outputted from the media playback unit 11 is inputted to the video display 12. The audio signal outputted from the media playback unit 11 is inputted to the power amplifier 13.

The video display 12 displays an image in response to the input video signal. A display device used as the video display 12 is not limited to any particular device. For example, a cathode ray tube (CRT), a liquid-crystal display (LCD), or a plasma display panel (PDP) may be used for the video display 12.

The power amplifier 13 amplifies the input audio signal, thereby outputting a drive signal to drive the speaker. The power amplifier 13 includes a plurality of power amplifier circuits responsive to the audio channel configuration with which the AV system 1 is compatible. Each power amplifier circuit amplifies the audio signal of each channel, and outputs the drive signal to the loudspeaker 14 of that channel. A plurality of loudspeakers 14 are also arranged in accordance with the audio channel configuration of the AV system 1. If the AV system 1 works with the above-referenced seven channels, the power amplifier 13 includes seven power amplifier circuits. The loudspeaker 14 also includes seven speakers for the seven channels. Each speaker is arranged at the appropriate position thereof in the listening environment.

The power amplifier 13 amplifies the audio signal of each channel and feeds the resulting drive signal to the loudspeaker 14 of that channel. The loudspeaker 14 thus emits the sound of that channel into space, thereby forming an acoustic field in response to the multi-channel configuration. The sound of the content is thus reproduced. The reproduced sound emitted from the speaker is lip synchronized with a video the video display 12 displays in response to the video signal.

The media playback unit 11, the video display 12, the power amplifier 13, and the loudspeaker 14 in the AV system may be separately arranged in each unit in an component AV system. Alternatively, at least two of these units may be housed in a single casing.

If the acoustic correction apparatus 2 of the present embodiment is added onto the AV system 1, the audio signal from the media playback unit 11 is inputted to the acoustic correction apparatus 2 as shown in FIG. 9. As shown in FIG. 7, the acoustic correction apparatus 2 has seven audio input terminals to be compatible with a maximum of seven channels including the center channel (C), the front left channel (L), the front right channel (R), the left surround channel (Ls), the right surround channel (Rs), the left back surround channel (Bsl), and the right back surround channel (Bsl) as shown in FIG. 7. In actual AV systems, a sub-woofer channel is usually added in addition to the seven channels. The discussion of the sub-woofer is omitted here for simplicity of explanation.

If the AV system 1 is compatible with only L and R channels, the acoustic correction apparatus 2 is connected so that the L and R audio signals outputted from the media playback unit 11 are inputted to input terminals of the front left channel (L) and the front right channel (R) of the seven channels of the acoustic correction apparatus 2.

The acoustic correction apparatus 2 has the audio signal output terminals to output a maximum of seven audio signals. The audio signal outputted from the acoustic correction apparatus 2 are inputted to the respective audio input terminals of the power amplifier 13.

If the audio signal read from the medium is an encoded (compressed) one, the media playback unit 11 decodes the audio signal into a digital audio signal, and outputs the digital audio signal. The audio signal, if encoded, needs to be decoded before being fed to the acoustic correction apparatus 2. The acoustic correction apparatus 2 does not need both an encoder for encoding the audio signal and a decoder for decoding the audio signal.

The test sound the acoustic correction apparatus 2 outputs to the power amplifier 13 is an audio signal subsequent to a decoding process or prior to an encoding process. During the reproduction of the test sound, both the encoding process and the decoding process are not necessary.

The acoustic correction apparatus 2 receives and outputs video signals. A video line connection is established so that the acoustic correction apparatus 2 receives a video signal from the media playback unit 11 and outputs the video signal.

As the audio signal, the video signal prior to the decoding process is processed by the acoustic correction apparatus 2.

The acoustic correction apparatus 2 receiving the video signal and the audio signal includes, as major elements thereof, a frame buffer 21, an acoustic field correction and measurement unit 22, a controller 23, and a memory 24.

The acoustic field correction and measurement unit 22 has two major functions. In one function, the acoustic field correction and measurement unit 22 measures a listening environment to set a acoustic control parameter value for acoustic field correction. In the measurement function, the acoustic field correction and measurement unit 22 outputs a signal for the test sound to the power amplifier 13 to output the test sound from the audio channel as necessary.

In accordance with the acoustic control parameter set in response to the measurement results through the measurement function, the acoustic field correction and measurement unit 22 performs required signal processing on the audio signal of each channel inputted from the media playback unit 11, and outputs the processed audio signal to the power amplifier 13. The acoustic field formed by the sound of the content outputted by the speaker is appropriately corrected at the listening position.

In the signal processing for acoustic control, the audio signal from the media playback unit 11 is supplied to the DSP in the acoustic correction apparatus 2. The audio signal, when having passed through the DSP, is subject to a time lag in playback time to the video signal outputted from the media playback unit 11. The frame buffer 21 overcomes the time lag, thereby establishing lip synchronization. The controller 23 temporarily stores the video signal inputted from the media playback unit 11 on the frame buffer 21 on a frame by frame basis, and then outputs the video signal to the video display 12. The acoustic correction apparatus 2 thus outputs the video signal and the audio signal with the time lag eliminated and the playback time appropriately synchronized.

The controller 23 controls write and read operation of the frame buffer 21, functional blocks in the acoustic correction apparatus 2, and a variety of processes.

The memory 24, including a non-volatile memory, performs the write and read operation under the control of the controller 23. Data to be stored in the memory 24 is waveform data of the fundamental wave (see FIG. 1) to generate the test sound. Another data to be stored in the memory 24 is sequence data as control information to output a test sound melody in a tone train pattern of the predetermined sound elements as shown in FIG. 7.

In practice, the memory 24 stores setting information referenced by the controller 23, and required information other than the sequence data.

The microphone 25 is attached to the acoustic correction apparatus 2. When the acoustic correction apparatus 2 performs a test operation, the microphone 25 needs to be connected to the acoustic correction apparatus 2 to pick up the test sound outputted from the loudspeaker 14.

Figure 10:
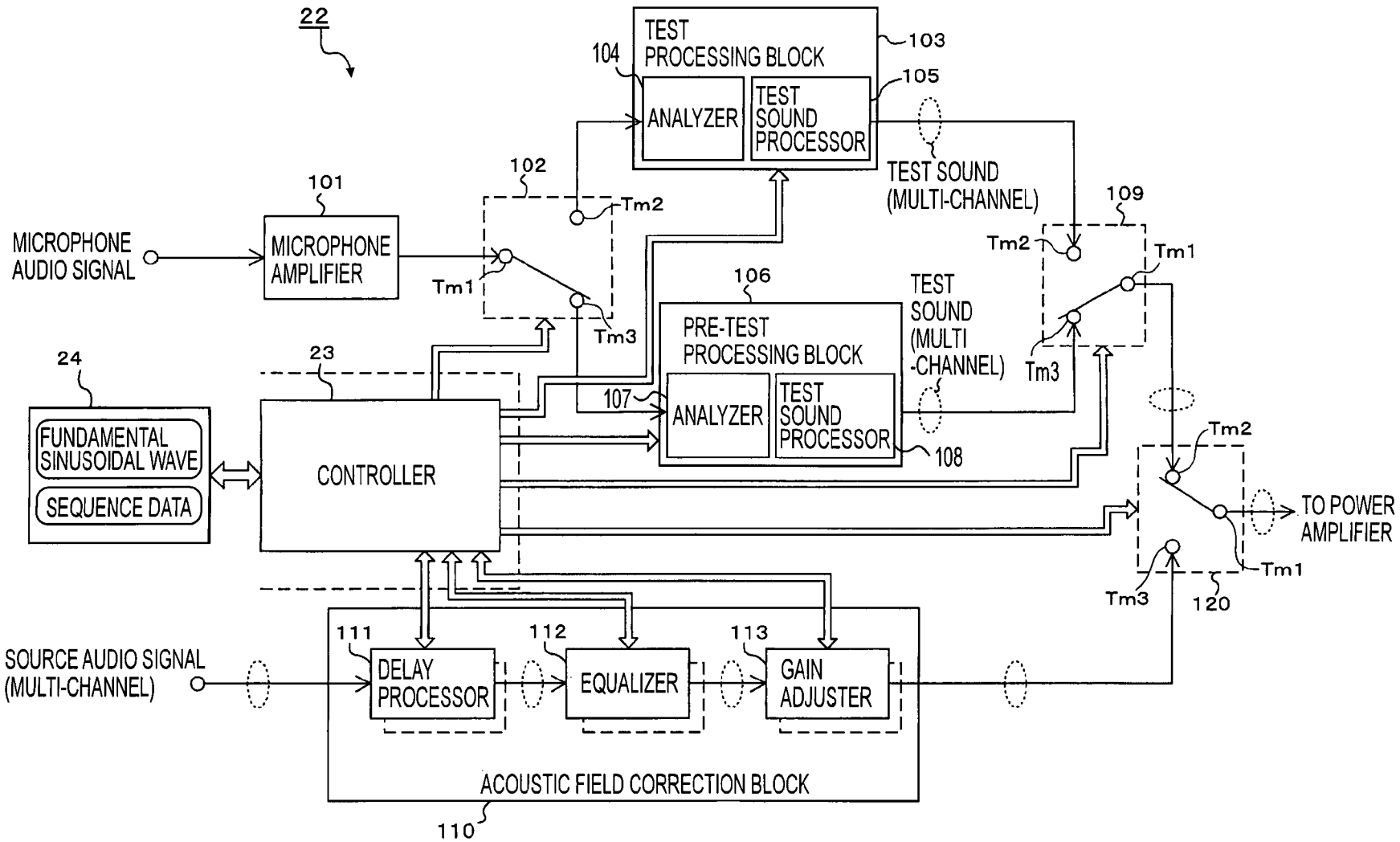
FIG. 10 is a block diagram illustrating the acoustic correction system in accordance with one embodiment of the present invention.

FIG. 10 illustrates an internal structure of the acoustic field correction and measurement unit 22. The acoustic field correction and measurement unit 22 includes, as major elements thereof, a microphone amplifier 101, a test processing block 103, a pre-test processing block 106, and an acoustic correction block 110. The acoustic correction block 110 performs an acoustic correction process while the microphone amplifier 101, the test processing block 103, and the pre-test processing block 106 perform a test measurement process. Based on the results of the measurement process, parameter values for the acoustic correction are set and modified in the acoustic correction block 110.

Switches 102 and 109 are arranged to switch between a test mode and a pre-test mode. Furthermore, a switch 120 is arranged to switch between a measurement mode and an acoustic correction mode. The switches 102, 109, and 120 are operated with a terminal Tm1 alternately connected to a terminal Tm2 and a terminal Tm3. The switching action of each switch is controlled by the controller 23.

The pre-test measurement mode of the acoustic field correction and measurement unit 22 is described below with reference to FIG. 10.

During the pre-test measurement mode, the controller 23 causes the switch 120 to connect the terminal Tm1 to the terminal Tm2. In each of the switches 102 and 109, the terminal Tm1 is connected to the terminal Tm3. The acoustic field correction and measurement unit 22 thus establishes a signal path for the pre-test measurement mode.

Figure 11:
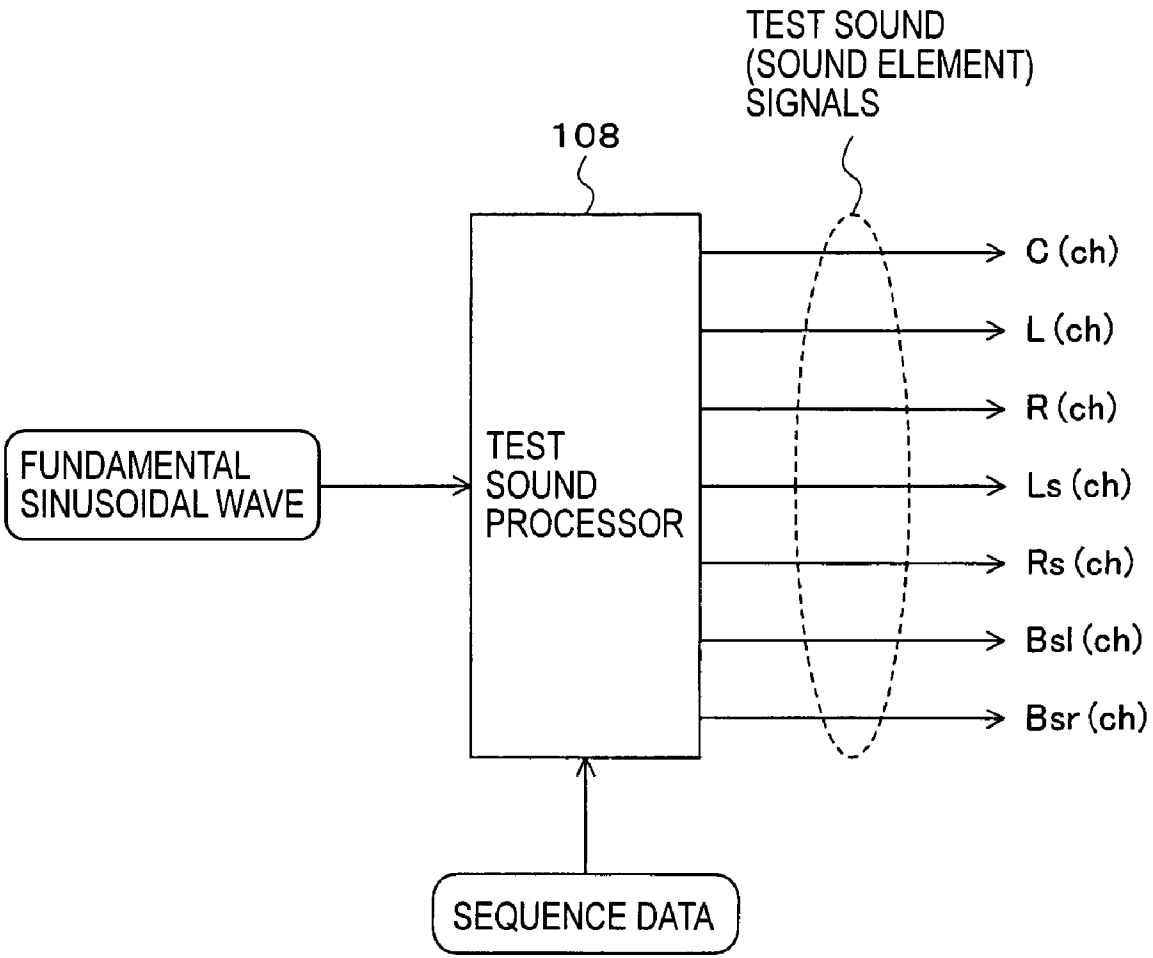
FIG. 11 is a block diagram illustrating an actual signal output configuration in a test sound processor in a pre-test processing block.

As shown in FIG. 10, the pre-test processing block 106 includes an analyzer 107 and a test sound processor 108. As shown in FIG. 11, the test sound processor 108 receives waveform data of the fundamental sinusoidal wave, generates the sound element for a predetermined pitch, and outputs the sound element as the test sound for the pre-test measurement mode in an audio signal format.

The sound element generation process of the test sound processor 108 follows the sound element generation technique discussed with reference to FIG. 4. As shown in FIG. 7, the test sound is outputted for the multi-channels on a per channel basis. For simplicity, only one signal output line from the test sound processor 108 is shown in FIG. 10. In practice, test signal output lines are arranged for respective seven channels as shown in FIG. 11.

In accordance with a control content described in the sequence data, the test sound processor 108 generates a particular frequency component corresponding to a particular pitch as a sound element, and outputs the generated sound element via a particular signal line.

At a predetermined timing, the waveform data of the fundamental sinusoidal wave is read from the memory 24 under the control of the controller 23 and inputted to the test sound processor 108. Rather than directly inputting the sequence data to the test sound processor 108, the controller 23 reads and interprets the sequence data from the memory 24, and then informs, of the test sound processor 108, the pitch (frequency) of the sound element to be generated and the audio channel to output the sound element therethrough.

The process of the test sound processor 108 for generating one sound element is described below with reference to a block diagram shown in FIG. 12.

The test sound processor 108 receives the waveform data of the fundamental sinusoidal wave. An m-th harmonic wave processor 201 generates an m-th sinusoidal wave for an m-th order as the base sound of the sound element corresponding to the designated pitch. The frequency of the m-th sinusoidal wave thus generated is defined by equation (2). The m-th order, i.e., the frequency of the base sound is controlled by the controller 23 in accordance with the content of the sequence data.

The waveform data of the fundamental sinusoidal wave used by the m-th harmonic wave processor 201 may be the waveform data of one period shown in FIG. 1. The waveform data of one-quarter of the period is a minimum amount. More specifically, if the waveform data of one-quarter period is available, a sinusoidal wave of one full period is easily formed by a simple calculation. The one-quarter period waveform data as the minimum amount means a reduced amount of data, and a memory capacity of the memory 24 is thus saved.

The m-th sinusoidal wave generated by the m-th harmonic wave processor 201 serves as a base sound of the sound element at an octave order k=1 as heretofore described. The waveform data of the m-th sinusoidal wave generated by the m-th harmonic wave processor 201 is transferred to a level adjuster 203-1 and an octave harmonic wave generator 202.

The octave harmonic wave generator 202 performs a multiplication process on the m-th sinusoidal wave received as the base sound from the m-th harmonic wave processor 201 (for multiplying the m-th sinusoidal wave by twice, four times, eight times, 16 times, and 32 times). The octave harmonic waves of octave orders of k=2, k=3, k=4, k=5, and k=6 are thus generated. Multiplication process may be based on the concept shown in FIG. 1. Decimation sampling is performed on the octave harmonic waves in accordance with the octave order with the m-th sinusoidal wave serving as the base sound.

The octave harmonic waves with the octave orders k=2, k=3, k=4, k=5, and k=6 are transferred to level adjusters 203-2, 203-3, 204-4, 203-5, and 203-6, respectively.

The six level adjusters 203-1 through 203-6 respectively receive the m-th octave harmonic waves with the base sound (k=1), and the octave orders k=2 through 6.

The level adjusters 203-1 through 203-6 sets predetermined amplitude values to the base sound and the octave harmonic waves. The amplitude values set by the level adjusters 203-1 through 203-6 may be fixed beforehand, or varied under the control of the controller 23.

The base sound and the octave harmonic waves, level adjusted by the level adjusters 203-1 through 203-6, are synthesized into a single sound element (audio signal waveform) by a synthesizer 204. The sound element, synthesized by the synthesizer 204, contains a tone of an amplitude balance of the base sound and the octave harmonic wave, reflecting the level adjustment performed by the level adjusters 203-1 through 203-6.

Figure 12:
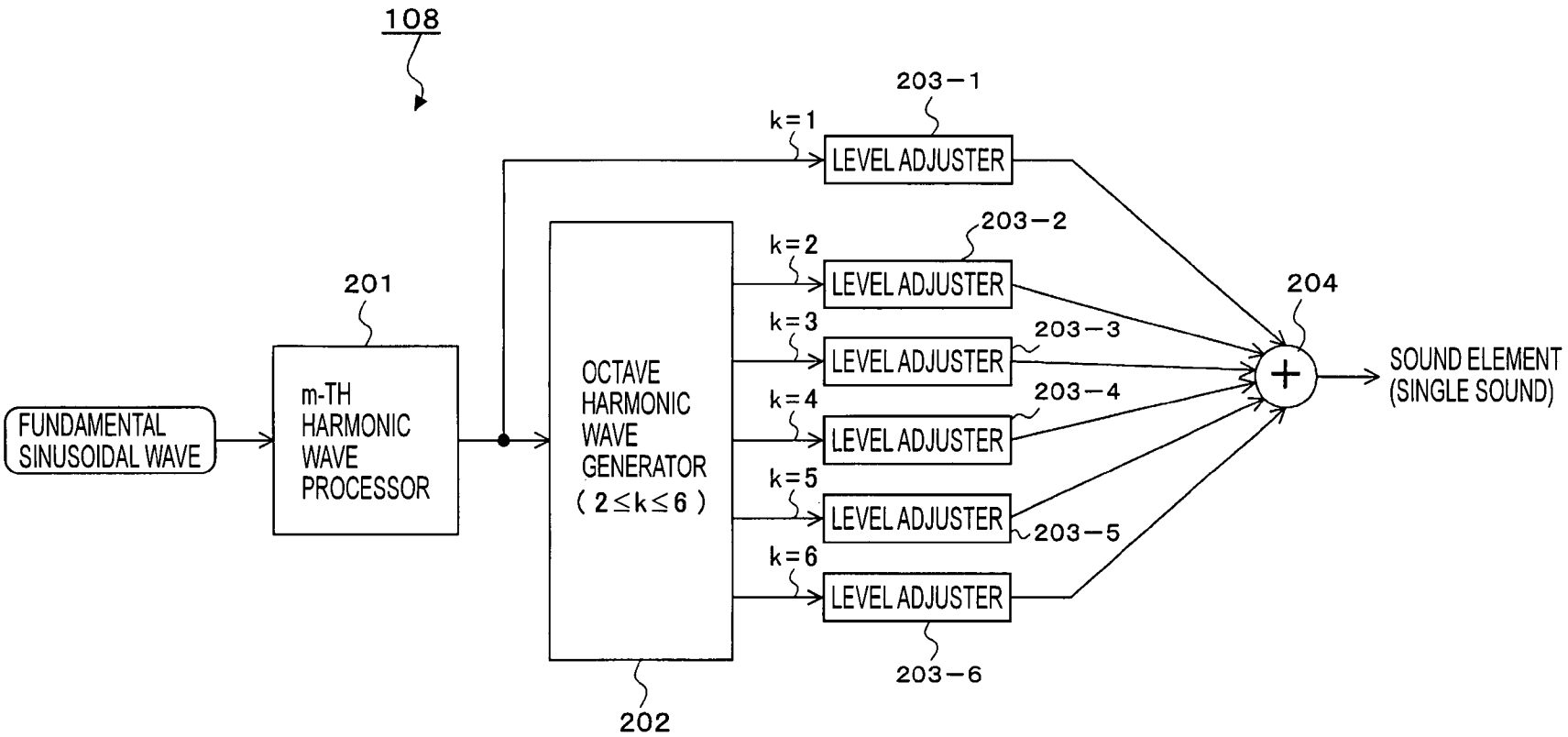
FIG. 12 is a block diagram illustrating a sound element generation process in the test sound processor in the pre-test processing block.

The sound element produced in accordance with the process of FIG. 12 matches the sample count N. For example, to output the sound element during the output period Ta of FIG. 7, the test sound processor 108 outputs twice consecutively the sound element generated in accordance with the process of FIG. 12.

The test sound processor 108 performs the process of FIG. 12 in parallel, thereby concurrently generating the sound element corresponding to different pitches. The audio signal as the sound element generated in accordance with the process of FIG. 12 is outputted via output lines corresponding to at least one audio channel as a test sound signal.

As shown in FIG. 10, the test sound signal composed of the sound element outputted from the test sound processor 108 in the pre-test processing block 106 is inputted to the power amplifier 13 via the switch 109 (terminal Tm3→terminal Tm1) and the switch 120 (terminal Tm2→terminal Tm1). The power amplifier 13 of FIG. 9 amplifies the audio signal of the input test sound, and outputs the test sound from the loudspeaker 14.

When the test sound processor 108 concurrently outputs the audio signals of the test sounds (sound elements) of a plurality of channels, the power amplifier 13 thus amplifies the audio signal of each channel and outputs the test sound from the corresponding loudspeaker 14.

The loudspeaker 14 emits the real test sound in space surrounding the loudspeaker 14.

During the pre-test and test, the memory 24 is connected to the acoustic correction apparatus 2 to pick up the test sound as shown in FIG. 9. An audio signal picked up by the microphone 25 connected to the acoustic correction apparatus 2 is inputted to the microphone amplifier 101 in the acoustic field correction and measurement unit 22 of FIG. 10.

The microphone 25 is placed at a listening position where the best corrected acoustic field is established in an listening environment. For example, the system of FIG. 9 may be an onboard automobile audio system, and a user may wish to establish an appropriate acoustic field at the driver's seat. With the user at the driver's seat, the microphone 25 is placed to the position where the ears of the user is expected to be positioned.

When the test sound is emitted from the loudspeaker 14 in response to the test sound signal outputted from the test sound processor 108 in the pre-test measurement mode, the microphone 25 picks up an ambient sound containing the test sound. The audio signal of the picked-up sound is amplified by the microphone amplifier 101 and supplied to the analyzer 107 in the pre-test processing block 106 via the terminal Tm1 and the terminal Tm3 in the switch 102.

The analyzer 107 samples the input audio signal at the timing previously discussed with reference to FIG. 5 into the response signal, and performs the FFT frequency analysis process on the response signal. Upon receiving the frequency analysis result, the controller 23 provides measurement results based on the frequency analysis results as previously discussed with reference to FIG. 8.

During the test mode, the controller 23 causes the switch 120 to continuously keep the terminal Tm1 connected to the terminal Tm2 while causing the switches 102 and 109 to connect the terminal Tm1 to the terminal Tm2. The acoustic field correction and measurement unit 22 thus establishes a signal path for the test mode.

A test processing block 103 functions during the test mode instead of the pre-test processing block 106. The test processing block 103 includes an analyzer 104 and a test sound processor 105. During the test mode, the test sound processor 105 generates a predetermined signal waveform, and outputs the signal waveform as the test sound. During the test mode, a test sound other than the test sound caused by the sound element used in the pre-test measurement may also be used.

The levels of the test sounds outputted from the speakers of the channels are set based on the measurement results obtained in the pre-test measurement mode. During the pre-test measurement mode, the presence or absence of the speakers (channel configuration) is determined, and no output is provided to any channel of a speaker that is determined to be absent in the AV system. The workload on the test sound processor 105 is thus lightened. The controller 23 sets the level of the test sound and the output of the test sound response to the channel configuration by controlling the test sound processor 105 based on the measurement results.

When the signal of the test sound is outputted from the test sound processor 105 in the test processing block 103, the microphone 25 picks up an ambient sound containing the test sound in the same way as in the pre-test measurement mode. The picked up sound is then inputted to the analyzer 104 via the terminal Tm1 and the terminal Tm2 in the switch 102.

The analyzer 104 samples the input audio signal at a predetermined timing responsive to the test sound output into the response signal, and FFT frequency analysis process on the response signal. Upon receiving the frequency analysis results, the controller 23 provides measurement results for the test. For example, the controller 23 determines a value for a predetermined parameter for acoustic correction.

Both the analyzer 104 in the test processing block 103 and the analyzer 107 in the pre-test processing block 106 perform a common function of FFT frequency analysis. The pre-test measurement process and the test process are not concurrently performed. The analyzer 104 and the analyzer 107 can be integrated into one unit that is shared by the pre-test process and the test process.

To initiate the acoustic correction mode, the switch 120 is operated to connect the terminal Tm1 to the terminal Tm3. The switches 102 and 109, used to switch between the test mode and the pre-test mode, can be at any switch status.

During the acoustic correction mode, an acoustic field correction block 110 receives a source audio signal. The source audio signal is an audio signal reproduced and outputted by the media playback unit 11. As previously discussed, a plurality of audio signals of a maximum of seven channels can be inputted. The acoustic field correction block 110 includes a delay processor 111, an equalizer 112, and a gain adjuster 113. Each of these elements can independently process the audio signals of a maximum of seven channels.

The delay processor 111 in the acoustic field correction block 110 delays the input audio signals by delay times different from channel to channel, and outputs the delayed audio signals. The delay processor 111 corrects a disturbance in the acoustic field caused by a time difference between propagation times responsive to distances from the speakers to the listening position.

The equalizer 112 sets equalizing characteristics to the input audio signals independently from channel to channel. Some equalizers 112 may correct variations in sound quality caused by the relationship between the position of the speakers and the listening position, a status of an object present between any speaker and the listening position, and variations in reproduction and acoustic characteristics of the speaker.

The gain adjuster 113 sets gain on the input audio signals independently from channel to channel. Some gain adjusters 113 corrects variations in volume caused by the positional relationship between the speaker and the listening position, the status of the object present between the speaker and the listening position, and the variations in the reproduction and acoustic characteristics of the speaker.

The acoustic field correction block 110 having such signal processing functions may be constructed of a DSP for audio signal processing.

The controller 23 has now acquired, as a result of the test measurement, the relationship of time differences of arrival audio signals having traveled to the listening position from channel to channel, a change in sound quality and variations in level of the sound at the arrival of the sound to the listening position.

Set as one parameter for acoustic correction is a delay time for each audio channel in the media playback unit 11 to eliminate the time difference based on the information relating to the time difference between arrival times of the sounds that arrive at the listening position.

Equalizing characteristics are set in the equalizer 112 on a per channel basis to compensate for the change in sound quality in accordance with the information relating to the sound quality change at the arrival of the sound at the listening position. Gain is set in the gain adjuster 113 on a per channel basis to eliminate variations in volume in accordance with the information relating to the variations in level of the sounds at the arrival at the listening position.

The source audio signal inputted to the acoustic field correction block 110 is processed by the delay processor 111, the equalizer 112, and the gain adjuster 113. The processed signal is then amplified by the power amplifier 13, and the amplified signal is then emitted from the loudspeaker 14 as a real sound.

The acoustic field is formed by the emitted sound. The user thus listens to the sound in an improved acoustic field.

Figure 13:
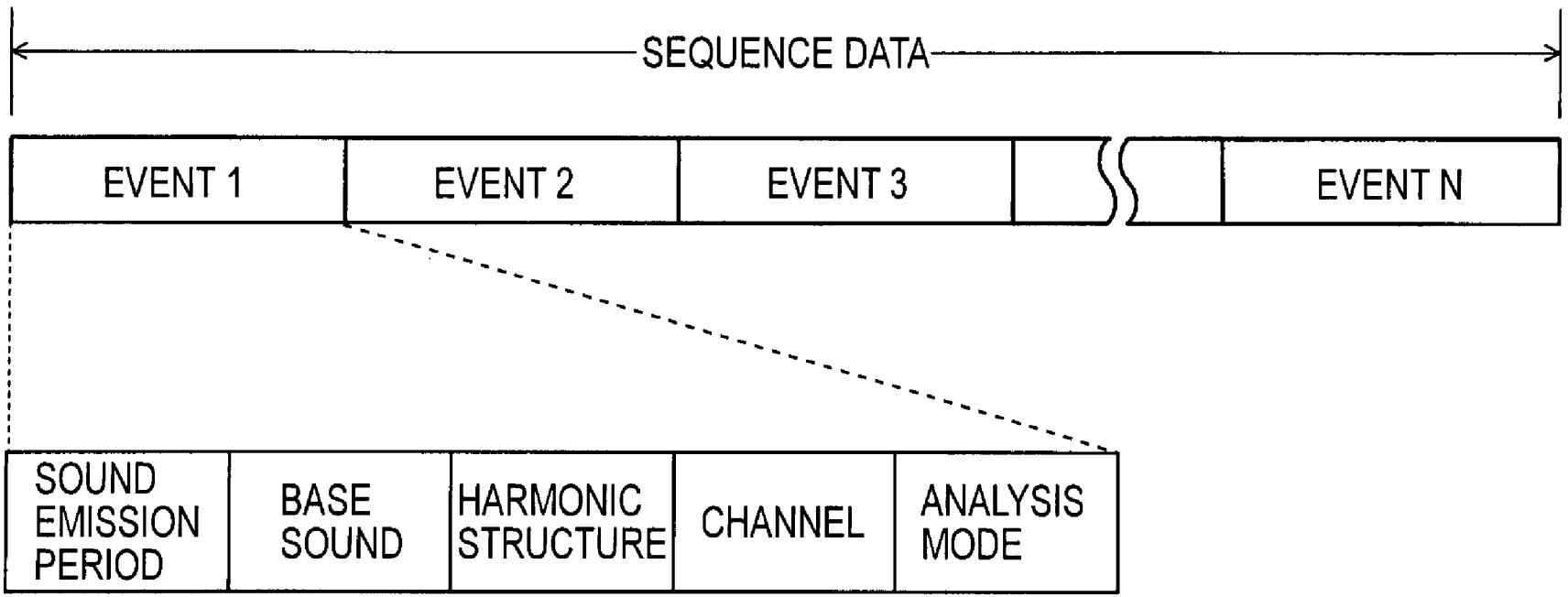
FIG. 13 illustrates the structure of sequence data.

FIG. 13 illustrates the structure of the sequence data. This structure is shown for exemplary purposes only.

The sequence data is produced with event units concatenated. One event is data corresponding to a single sound element. Each event holds information relating to a sound emission period, a base sound, a harmonic structure, a channel, and an analysis mode.

The sound emission period information defines an output timing of the sound element corresponding to a current event. More specifically, the sound emission period defines how many times the output of the sample count N is repeated, and the timing of the output of the sample count N. For example, the start point of the output of the sound element as the test sound melody is set to a zero point, and the output timing is defined by designating the sum of the sample count from the zero point. The resolution of the output timing is time corresponding to one period of the sampling frequency.

The base sound information designates the order m of the m-th sinusoidal wave as the base sound.

The harmonic structure information defines a balance of the amplitudes of the octave harmonic waves of the octave order k=2 through 6 with respect to the base sound. The tone of each sound element is thus determined. The balance of the amplitudes of the octave harmonic waves takes into consideration not only the tone of the sound element, but also achievement of good measurement results appropriate for test conditions.

The test sound is generated in accordance with the harmonic structure information during the first analysis mode, but the test sound is adaptively modified to result better measurement results during the second analysis mode in accordance with the measurement results of the first analysis mode.

The channel information specifies an audio channel to output the sound element. To output the sound elements of the same pitch from a plurality of channels, the channel information preferably specifies a plurality of channels. With this arrangement, a single event is used to output the sound elements of the same pitch from the plurality of channels without the need for producing a plurality of events.

The analysis mode information specifies the analysis mode of the sound element. In accordance with the example illustrated in FIGS. 7 and 8, the analysis mode information specifies one of the first analysis mode, the second analysis mode, and the non-analysis mode. In response to the mode specified by the analysis mode information, the controller 23 determines whether to analyze the sound of the sound element. If it is determined that the analysis is to be performed, the controller 23 obtains the measurement results of one of the first analysis and the second analysis in response to the mode analysis information. The mode analysis information may contain information specifying the sample delay time Tdrs.

In accordance with the sequence data, the controller 23 controls the pre-test processing block 106, thereby outputting the sound element at the pitch and the output timing specified in the sequence data. As shown in FIG. 7, the test sound is thus melodically outputted.

Figure 14:
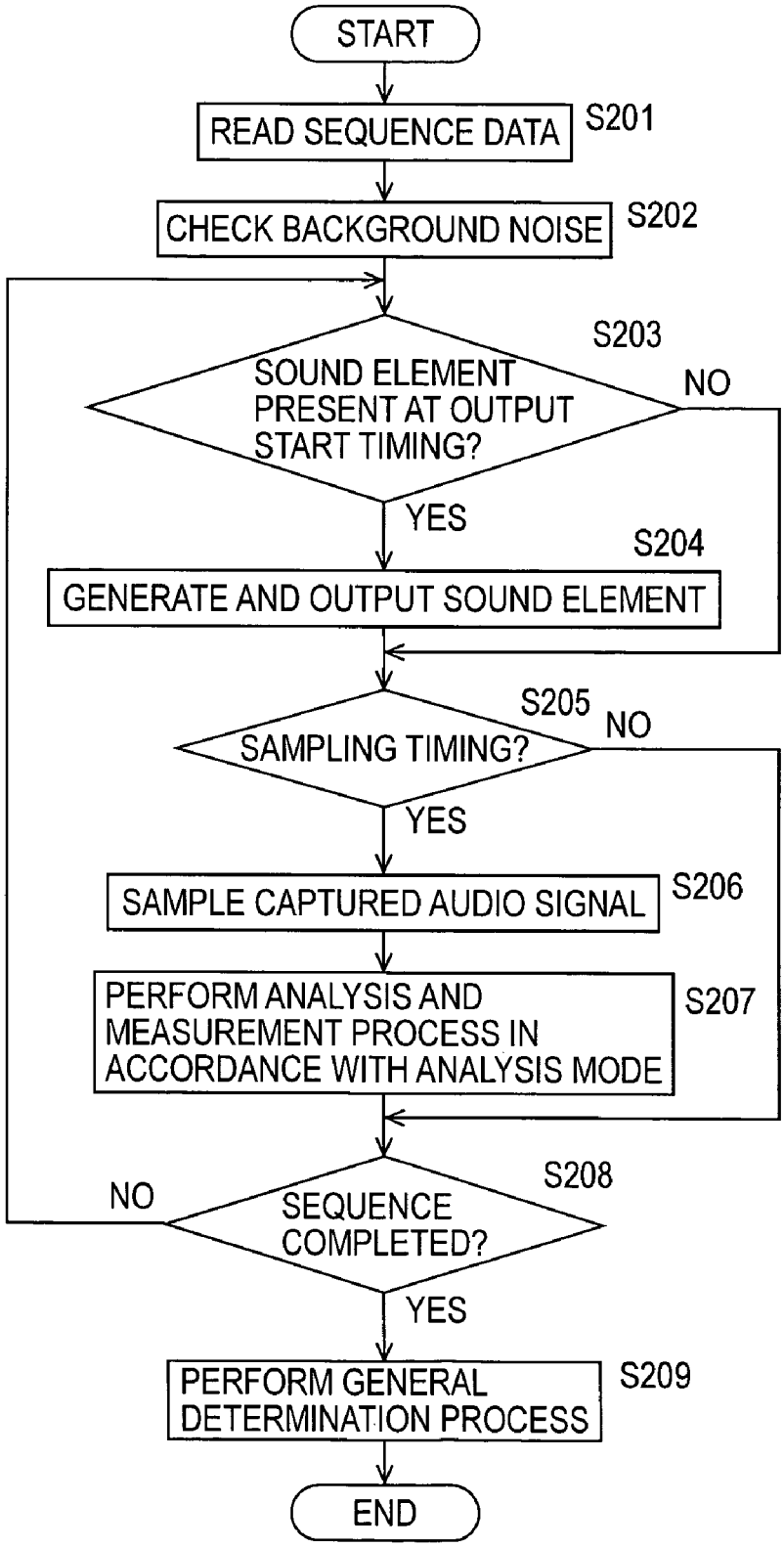
FIG. 14 is a block diagram illustrating an operation performed by a controller (microcomputer) for pre-test measurement.

FIG. 14 is a flowchart of a control process of the pre-test measurement performed by the controller 23.

In step S201, the controller 23 reads the predetermined sequence data from the frame buffer 21. The controller 23 hereinafter analyzes the content of the read sequence data and performs the control process.

In step S202, the controller 23 checks the background noise. This process is identical to the process in step S101 of FIG. 8. The process in step S203 and subsequent steps is performed if the background noise check results reveal that the microphone 25 is connected.

In step S203 and subsequent steps, the event is processed based on the interpretation of the sequence data.

In step S203, the controller 23 references information of the emission period of an unprocessed event to determine whether any sound element, from among sound elements that have not yet been started, reaches an output start timing. If it is determined that no sound element has reached an output start timing, the controller 23 proceeds to step S205 with step S204 skipped. If it is determined that any sound element has reached an output start timing, the controller 23 performs the process in step S204.

In step S204, the controller 23 references the base sound described in the event information and the harmonic structure information of the sound element the controller 23 has determined as being outputted in step S203. The controller 23 performs a process for generating the sound element. The generated sound element is repeated by a number of repetition in accordance with the information of the sound emission period described in the event of the sound element. The channel to output the audio signal of the sound element is determined in accordance with the channel information described in the same event.

Each time the sound element is outputted in step S204, a sampling process event is generated at the sample delay time Tdrs. In step S205, the controller 23 determines whether any of the sampling process events thus generated reaches a start timing. If it is determined that no sampling process event reaches a start timing, the controller 23 proceeds to step S208 with steps S206 and S207 skipped. If it is determined that any sampling process event reaches a start timing, the controller 23 proceeds to step S206.

In step S206, the controller 23 samples the audio signal picked up by the microphone 25 with the predetermined sample count N at the timing accounting for the sample delay time Tdrs. In step S207, the controller 23 performs the FFT frequency analysis on the response signal, obtained through the sampling process in step S206, in accordance with the analysis mode specified by the event of the sound element. The controller 23 performs the process based on the analysis result in order to obtain the measurement results in accordance with the analysis mode specified in the event.

The controller 23 determines in step S208 whether the sequence has been completed, in other words, whether the event process has been completed on the sequence data read in step S201, and whether the sampling process and the analysis process in accordance with the sequence data have been completed. If it is determined that the sequence has not been completed, the controller 23 returns to step S203. If it is determined that the sequence has been completed, the controller 23 proceeds to step S209.

In step S209, the controller 23 performs the same general determination process as the one in step S119 of FIG. 8.

In accordance with the present embodiment, the test sound melody is determined by the sequence data. In the simplest form, the sequence data is stored beforehand in the memory 24, and the test sound melody is outputted in accordance with the test sound melody. Alternatively, a plurality of pieces of sequence data may be stored in the memory 24. One sequence data is selected and used depending on a selection operation of the user and predetermined conditions in the pre-test measurement.

The sequence data may be stored in the memory 24 prior to the shipment of the apparatus from a factory. Alternatively, after acquiring the sequence data from the outside, the user may download the sequence data to the memory 24 when the user gets the acoustic correction apparatus 2.

In the output sequence of the test sound in the non-analysis mode, the melody, the tone of the sound element, and the speaker outputting the sound element may be modified in response to user editing operation. Such an arrangement enhances the degree of entertainment. An inadvertent modification of the output of the sound element for the analysis mode can disturb effective testing, and it is preferred to exclude from the user editing procedure the modification of the output sequence of the test sound for the analysis mode.

In accordance with the present embodiment, the basic waveform data is stored, and all necessary sound elements are generated on the stored waveform data. Since a source of the desired sound element is a single piece of basic waveform data, no large memory area is not required in the storage capacity of the acoustic correction apparatus 2. If the storage capacity is large enough, the waveform data of all sound elements required to produce the test sound melody is produced and stored beforehand as sound source data. To output the test sound melody, the sound source data is read from the storage area and reproduced.

In accordance with the concepts of FIGS. 2 and 4, only the sound elements forming a musical scale is used as the sound element for the test sound melody. A sound element not matching any musical scale can be a target frequency as long as the sound element is based on the m-th sinusoidal wave with an integer multiple of periods thereof matching the sample count N. There is no problem with using such a sound element for the test sound melody. To the contrary, using a sound element unmatching a musical scale for a test sound melody can be more effective in music as a test sound melody, and it is advisable to use more such a sound element.

Since the response signal is not frequency analyzed during the non-analysis mode, it is not necessary to output a test sound based on the m-th sinusoidal wave with an integer multiple of periods thereof matching the sample count N. If a waveform other than that based on the m-th sinusoidal wave is used during the non-analysis mode, a melody with a variety of tones as a series of test sound output sequence is created. The test sound thus becomes sophisticated in terms of music and entertainment. If a sound produced by sampling an actual sound of a musical instrument is used as a waveform other than that based on the m-th sinusoidal wave, the test sound melody becomes more like music.

A single omnidirectional monophonic microphone effectively serves as the microphone 25 for picking up the test sound. More reliable measurement results may be expected if a plurality of microphones are arranged at appropriate locations, if a stereophonic microphone is used, or if a plurality of binaural microphones are used.

The test sound processor 108 and the analyzer 107 in the pre-test processing block 106 in the acoustic correction apparatus 2 of FIG. 10 generates the sound element, performs control process for producing the test sound melody (outputting the generated sound element at a timing responsive to the sequence data), samples the picked up audio signal at the predetermined timing, and performs the FFT frequency analysis process on the response signal. These processes may be performed by a hardware arrangement. The acoustic correction apparatus 2 may be embodied by a microcomputer, and a central processing unit (CPU) thereof may perform the processes under the control of computer programs. Referring to FIG. 10, the controller 23 corresponds to the CPU, and the pre-test processing block 106 is implemented in software. The function of the pre-test processing block 106 is thus performed by a CPU in the controller 23.

The test processing block 103 and the acoustic field correction block 110 may be implemented in hardware or in software.

In the above discussion, the test sound based on the m-th sinusoidal wave is used for the pre-test measurement for acoustic correction. The test sound may be used for the test without any problem depending on test environment and test conditions. The present invention is not limited to the acoustic correction as long as the sound falling within the human auditory sensation area is handled.

The FFT is used in the frequency analysis of the response signal of the test sound based on the m-th sinusoidal wave. Other frequency analysis methods including discrete Fourier transform (DFT) may also be used.

What is claimed is:

1. A test apparatus comprising:

output means for outputting, as a test sound source, a sound element according to a minimum output waveform unit equal to a predetermined sample count for analog to digital conversion expressed by a power of 2, wherein the sound element is generated based on a predetermined frequency component of a sinusoidal wave, a integer multiple of periods of the sinusoidal wave matching the predetermined sample count, and the predetermined frequency component from among a plurality of predetermined frequency components synthesized from a virtual base sound component and having a frequency higher than the virtual base sound component by a predetermined number of octaves, the virtual base sound component having a frequency equal to 1/(2P) of the predetermined frequency component, the predetermined frequency component having the integer multiple of periods matching the predetermined sample count, where P represents a natural number;

sampling means for sampling an audio signal obtained as a result of capturing a sound in space by a microphone placed at an expected listening position of a user in the space, at a predetermined timing according to the minimum output waveform unit equal to the predetermined sample count, wherein the space is external to the test apparatus and wherein a signal of the sound element outputted by the output means is emitted in the space as a test sound by a plurality of speakers arranged in the space at positions in accordance with a predetermined audio configuration used with the expected listening position; and test means for obtaining test results in terms of a predetermined test item from analysis results obtained by executing a predetermined frequency analysis on the audio signal sampled by the sampling means.

2. The test apparatus according to claim 1, wherein the output means outputs, as the sound element, a base sound signal component as the predetermined frequency component, and at least one predetermined frequency component synthesized from the base signal component and having a frequency higher than the base sound signal component by a predetermined number of octaves.

3. The test apparatus according to claim 1, wherein the output means outputs a next predetermined sound element at a predetermined timing subsequent to one predetermined sound element.

4. The test apparatus according to claim 1, wherein the output means outputs a predetermined number of sound elements with output periods thereof overlapping.

5. The test apparatus according to claim 1, wherein the output means outputs a designated sound element at a designated output start timing in accordance with control information that designates an output pattern of the sound element.

6. The test apparatus according to claim 1, wherein the output means outputs a sound element having a predetermined frequency component set as one standard frequency, from among the sound elements having the predetermined frequency component, the standard frequency being one pitch of a predetermined musical scale, and a sound element having a particular frequency component having a frequency serving as another pitch in the musical scale.

7. The test apparatus according to claim 1, further comprising:

storage means for storing basic waveform data of at least one-quarter of the sinusoidal wave having one period thereof matching the predetermined sample count expressed by a power of 2; and generating means for generating the predetermined frequency component based on the basic waveform data and generating the sound element based on the generated predetermined frequency component.

8. The test apparatus according to claim 1, wherein the sampling means samples the audio signal at a predetermined timing within a duration of time throughout which the signal of the sound element outputted by the output means is emitted in the space as the test sound.

9. A test method comprising steps of:

outputting from a test apparatus, as a test sound source, a sound element according to a minimum output waveform unit equal to a predetermined sample count for analog to digital conversion expressed by a power of 2, wherein the sound element is generated based on a predetermined frequency component of a sinusoidal wave, an integer multiple of periods of the sinusoidal wave matching the predetermined sample count and the predetermined frequency component from among a plurality of predetermined frequency components synthesized from a virtual base sound component and having a frequency higher than the virtual base sound component by a predetermined number of octaves, the virtual base sound component having a frequency equal to 1/(2P) of the predetermined frequency component, the predetermined frequency component having the integer multiple of periods matching the predetermined sample count, where P represents a natural number;

sampling an audio signal obtained as a result of capturing a sound in a space by a microphone placed at an expected listening position of a user in the space, at a predetermined timing according to the minimum output waveform unit equal to the predetermined sample count, wherein the space is external to the test apparatus and wherein a signal of the sound element outputted is emitted in the space as a test sound by a plurality of speakers arranged in the space at positions in accordance with a predetermined audio, configuration used with the expected listening position; and obtaining test results in terms of a predetermined test item from analysis results obtained by executing a predetermined frequency analysis on the audio signal sampled in the sampling step.

10. A non-transitory computer-readable medium with a computer program stored thereon executable by a computer for causing a test apparatus to perform a test method, the test method comprising:

outputting, as a test sound source, a sound element according to a minimum output waveform unit equal to a predetermined sample count for analog to digital conversion expressed by a power of 2, wherein the sound element is generated based on a predetermined frequency component of a sinusoidal wave, an integer multiple of periods of the sinusoidal wave matching the predetermined sample count and the predetermined frequency component from among a plurality of predetermined frequency components synthesized from a virtual base sound component and having a frequency higher than the virtual base sound component by a predetermined number of octaves, the virtual base sound component having a frequency equal to 1/(2P) of the predetermine frequency component, the predetermined frequency component having the integer multiple of periods matching the predetermined sample count, where P represents a natural number;

sampling an audio signal obtained as a result of capturing a sound in space by a microphone placed at an expected listening position of a user in the space, at a predetermined timing according to the minimum output waveform unit equal to the predetermined sample count, wherein the space is external to the computer and wherein a signal of the sound element outputted is emitted in the space as a test sound by a plurality of speakers arranged in the space at positions in accordance with a predetermined audio configuration used with the expected listening position; and obtaining test results in terms of a predetermined test item from analysis results obtained by executing a predetermined frequency analysis on the audio signal sampled in the sampling step.

* * * * *